US012715662B2

(12) United States Patent
Ludewig

(10) Patent No.: US 12,715,662 B2
(45) Date of Patent: Aug. 25, 2026

(54) CONTAINER HAVING METAL LID AND BOTTOM CONNECTED WITH PLASTIC CONNECTION RING

(71) Applicant: Jason W. Ludewig, Rockford, IL (US)

(72) Inventor: Jason W. Ludewig, Rockford, IL (US)

(73) Assignee: J.L. Clark LLC, Rockford, IL (US)

( * ) Notice: Subject to any disclaimer, the term of this patent is extended or adjusted under 35 U.S.C. 154(b) by 9 days.

(21) Appl. No.: 18/428,063

(22) Filed: Jan. 31, 2024

(65) Prior Publication Data

US 2024/0278960 A1 Aug. 22, 2024

Related U.S. Application Data

(60) Provisional application No. 63/507,642, filed on Jun. 12, 2023, provisional application No. 63/446,672, filed on Feb. 17, 2023.

(51) Int. Cl.

*B65D 43/02* (2006.01)
*B65D 1/34* (2006.01)
*B65D 43/16* (2006.01)

(52) U.S. Cl.

CPC ..... *B65D 43/021* (2013.01); *B65D 1/34* (2013.01); *B65D 43/162* (2013.01); *B65D 2401/05* (2020.05); *B65D 2543/00092* (2013.01); *B65D 2543/00277* (2013.01); *B65D 2543/00296* (2013.01); *B65D 2543/00509* (2013.01); *B65D 2543/00638* (2013.01); *B65D 2543/00685* (2013.01); *B65D 2543/00759* (2013.01); *B65D 2543/00796* (2013.01)

(58) Field of Classification Search

CPC ..... B65D 43/021; B65D 1/34; B65D 43/162; B65D 2401/05; B65D 2543/00092; B65D 2543/00277; B65D 2543/00296; B65D 2543/00509; B65D 2543/00638; B65D 2543/00685; B65D 2543/00759; B65D 2543/00796; B65D 43/169; B65D 51/28; B65D 2543/0024; B65D 2543/00518; B65D 2543/00546; B65D 2543/00731

USPC ..... 220/789, 521, 4.22

See application file for complete search history.

(56) References Cited

U.S. PATENT DOCUMENTS

| | | | |
|---|---|---|---|
| 2,490,746 | A | 12/1949 | Carpenter, Jr. |
| 2,737,311 | A | 3/1956 | Blacher |
| 3,088,623 | A | 5/1963 | Parker |
| 3,181,726 | A | 5/1965 | Parker |
| 3,334,714 | A | 8/1967 | Gordon |
| 3,620,407 | A | 11/1971 | Wise |
| 3,944,105 | A | 3/1976 | Chollet |
| 4,351,165 | A | 9/1982 | Gottsegen et al. |
| 4,440,307 | A | 4/1984 | Bartels et al. |
| 4,452,373 | A | 6/1984 | Pearce et al. |

(Continued)

FOREIGN PATENT DOCUMENTS

| | | | | |
|---|---|---|---|---|
| WO | WO-2010053952 A2 * | 5/2010 | ..... | B65D 15/18 |
| WO | WO-2024141336 A1 * | 7/2024 | ..... | A24F 23/00 |

*Primary Examiner* — Nathan J Jenness
*Assistant Examiner* — Eric C Baldrighi
(74) *Attorney, Agent, or Firm* — Reinhart Boerner Van Deuren P.C.

(57) ABSTRACT

A container including a container lid and a container bottom is provided. The container lid is a composite structure including a lid component and a connection ring connected to the lid component. The connection ring connects to the container bottom. The lid component may be a metal component.

17 Claims, 24 Drawing Sheets

(56) References Cited

U.S. PATENT DOCUMENTS

| | | | |
|---|---|---|---|
| 4,546,874 | A | 10/1985 | Kirchhan |
| 4,563,381 | A | 1/1986 | Woodland |
| 4,712,685 | A | 12/1987 | Kirchhan |
| 4,905,861 | A | 3/1990 | Boxall et al. |
| 5,069,354 | A | 12/1991 | Tannenbaum |
| 5,211,302 | A | 5/1993 | Tiramani |
| 5,676,272 | A | 10/1997 | Baerenwald |
| 5,782,371 | A | 7/1998 | Baerenwald et al. |
| 5,794,814 | A | 8/1998 | Baerenwald |
| 5,855,766 | A | 1/1999 | Mamiye et al. |
| 6,772,905 | B2 | 8/2004 | Cheng |
| 7,047,576 | B2 | 5/2006 | Tavivian |
| 8,485,390 | B2 | 7/2013 | Cronin |
| 9,205,959 | B2 | 12/2015 | Welk et al. |
| 2001/0035424 | A1 | 11/2001 | Combe et al. |

* cited by examiner

CONTAINER HAVING METAL LID AND BOTTOM CONNECTED WITH PLASTIC CONNECTION RING

CROSS-REFERENCE TO RELATED PATENT APPLICATIONS

This patent application claims the benefit of U.S. Provisional Patent Application No. 63/507,642, filed Jun. 12, 2023. This patent application also claims the benefit of U.S. Provisional Patent Application No. 63/446,672, filed Feb. 17, 2023, the entire teachings and disclosure each of which are incorporated herein by reference thereto.

FIELD OF THE INVENTION

This invention generally relates to containers and particular composite lids for containers that have metal bottoms.

BACKGROUND OF THE INVENTION

Loose tobacco and related tobacco products are typically packaged and sold in disc-shaped containers. However, other products such as candy are often distributed in these types of containers. In many cases, the containers comprise a metal lid seated upon either a metal, plastic or cardboard container bottom that is often referred to as a can. Often, a band-type label is adhesively secured over the seam between the lid and container bottom to securely fasten the lid and the container bottom.

Further, it is often desirable to provide as much metal as possible to reduce overall plastic consumption.

SUMMARY

The application discloses new and improved lids and containers having new and improved lids.

In one example, a container lid is provided that includes a metal lid component and a plastic connection ring. The metal lid component is cup shaped and includes a top wall and an annular lid sidewall connected to and extending from the top wall. The lid sidewall terminates in a distal end. The plastic connection ring circumscribes the lid sidewall. The connection ring has a first radially inward extending catch and a second radially inward extending catch axially spaced from the first radially inward extending catch forming a first axial gap therebetween. At least a portion of the lid sidewall is positioned within the first axial gap axially between the first and second radially inward extending catches securing the metal lid component to the plastic connection ring. The connection ring has a first radially outward extending catch and a second radially outward extending catch axially spaced from the first radially outward extending catch forming a second axial gap therebetween.

In one example, the first and second radially outward extending catches are positioned axially between the first and second radially inward extending catches.

In one example, the connection ring has a first ring sidewall and a second ring sidewall spaced radially outward from the first ring sidewall forming an annular groove therebetween. The first and second radially inward extending catches extend from the first ring sidewall. The first and second radially outward extending catches extend from the second ring sidewall.

In one example, a radially inner edge of the first radially inward extending catch defines an inner diameter that is less than an inner diameter defined by a radially inner edge of the second radially inward extending catch.

In one example, a rounded shoulder connects the lid sidewall to the top wall. The first radially inward extending catch defines an abutment surface having a rounded profile shaped and sized to mate with the rounded shoulder.

In one example, the connection ring has a top end and a bottom end. The metal lid component is positioned axially between the top end and bottom end of the connection ring.

In one example, the distal end of the lid sidewall is folded or curled radially inward forming a curl or a hem.

In one example, the lid sidewall has a groove formed in an outer periphery thereof. The second radially inward extending catch extends into the groove to secure the connection ring to the lid sidewall.

In an example, a container is provided. The container includes a container bottom having a bottom wall and an annular bottom sidewall extending from the bottom wall. The bottom sidewall has a radially inward extending projection. The projection defines an opening into a storage cavity of the container bottom. The container includes a lid according to any preceding example selectively engageable with the projection to removably secure the lid to the container bottom. The projection of the container bottom is positioned within the second axial gap axially between the first and second radially outward extending catches releasably securing the container bottom to the plastic connection ring.

In one example, when the connection ring is engaged with the projection of the container bottom, at a least a portion of the lid sidewall is axially received within the container bottom.

In one example, when the connection ring is engaged with the projection of the container bottom, the first radially inward and outward extending catches are positioned external of the container bottom and the second radially inward and outward extending catches are positioned within the container bottom.

In one example, the connection ring defines a central axis. The metal lid component has a maximum diameter measured perpendicular to the central axis. The projection defines a minimum diameter measured perpendicular to the central axis. The minimum diameter of the projection is greater than the maximum diameter of the metal lid component.

In one example, the second radially inward extending catch cooperates with the distal end of the lid sidewall and the first radially inward extending catch cooperates with a shoulder formed between the lid sidewall and the top wall.

In one example, the projection of the container bottom is a radially inwardly directed curled portion of the bottom sidewall.

In one example, when the container lid is attached to the container bottom, no portion of the metal lid component extends axially away from the container bottom beyond the connection ring.

In one example, the connection ring has a maximum radially outer periphery that has a same diameter as a maximum radially outer periphery of the bottom sidewall.

In one example, a gap is formed axially between a distal end of the bottom sidewall and a peripheral portion of the connection ring, the peripheral portion being positioned radially outward of the first and second radially outward extending catches.

In one example, the connection ring includes a first portion hingedly connected to a second portion. The first and second portions are formed from a single continuous piece of material.

In one example, the first radially inward extending catch and the second radially inward extending catch are provided by the first portion. The first radially outward extending catch and the second radially outward extending catch are provided by the second portion.

In one example, a tamper evidence strip is permanently attached to the first and second portions and is configured to be broken to transition the first portion relative to the second portion from a closed orientation to an open orientation.

In an example, a container lid including a metal lid component and a plastic connection ring is provided. The metal lid component is cup shaped and includes a top wall and an annular lid sidewall connected to and extending from the top wall. The lid sidewall terminates in a distal end and has a groove in an outer radial periphery thereof. The plastic connection ring circumscribes the lid sidewall. The connection ring has a first radially inward extending catch extending radially into the groove securing the metal lid component to the plastic connection ring. A first radially outward extending catch and a second radially outward extending catch axially spaced from the first radially outward extending catch form a second axial gap therebetween.

In an example, a container lid including a metal lid component and a plastic connection ring is provided. The metal lid component is cup shaped including a top wall and an annular lid sidewall connected to and extending from the top wall. The lid sidewall terminates in a distal end. The plastic connection ring circumscribes the lid sidewall. The connection ring has a first portion hingedly attached to a second portion. The metal lid component is attached to the first portion. The first portion of the connection ring and metal lid component define a cavity. The first portion has a hingedly attached door closing an opening into the cavity defined by the first portion when in a closed orientation and provides access to the cavity through the opening when in an open orientation.

In one example, the door is connected to the rest of the first portion by a living hinge.

In one example, the second portion of the plastic connection ring maintains the door of the first portion of the plastic connection ring in the closed orientation when the first portion is in a closed orientation relative to the second portion.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
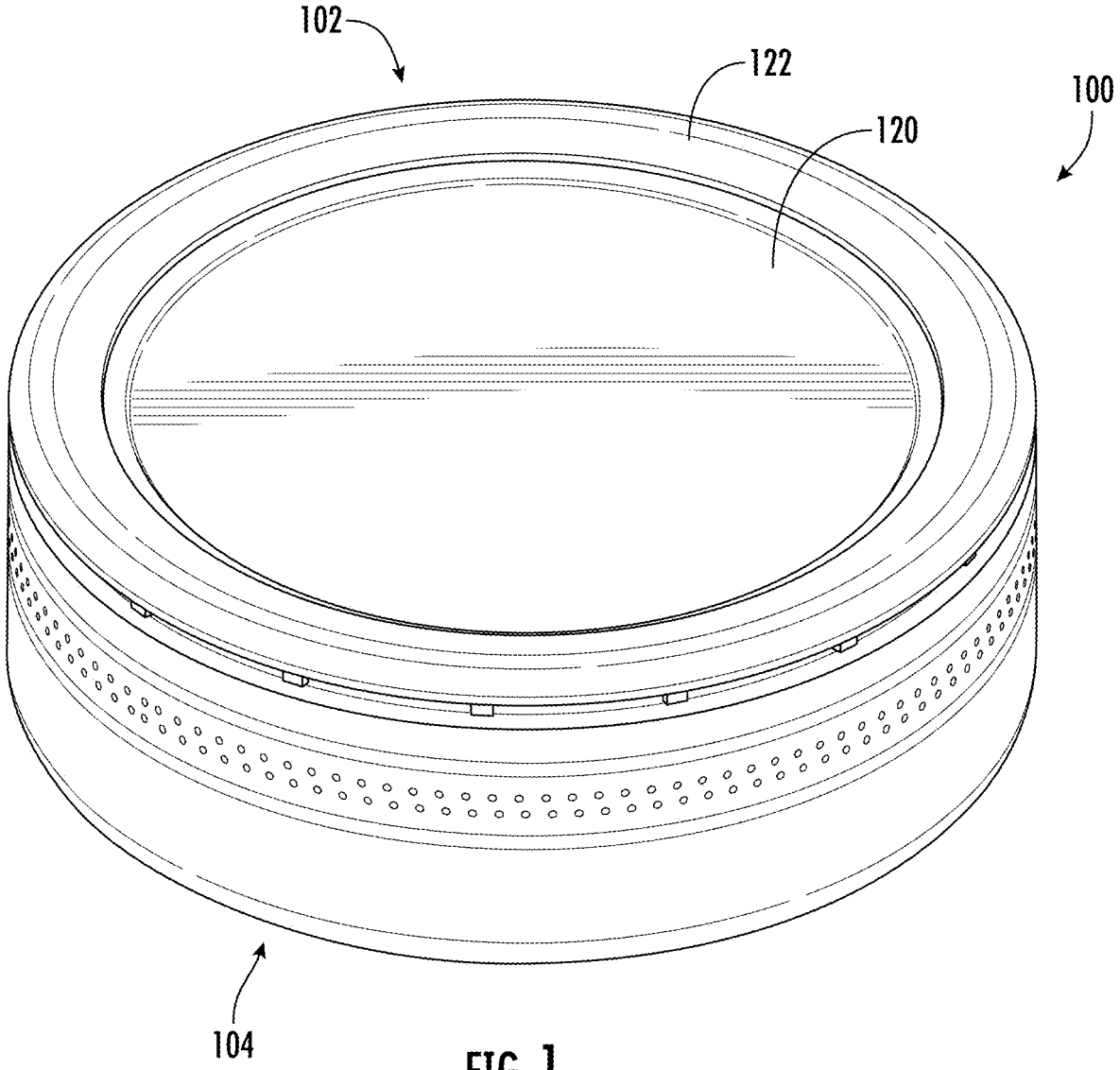
FIG. 1 is a perspective illustration of a first example of a container.
Figure 2:
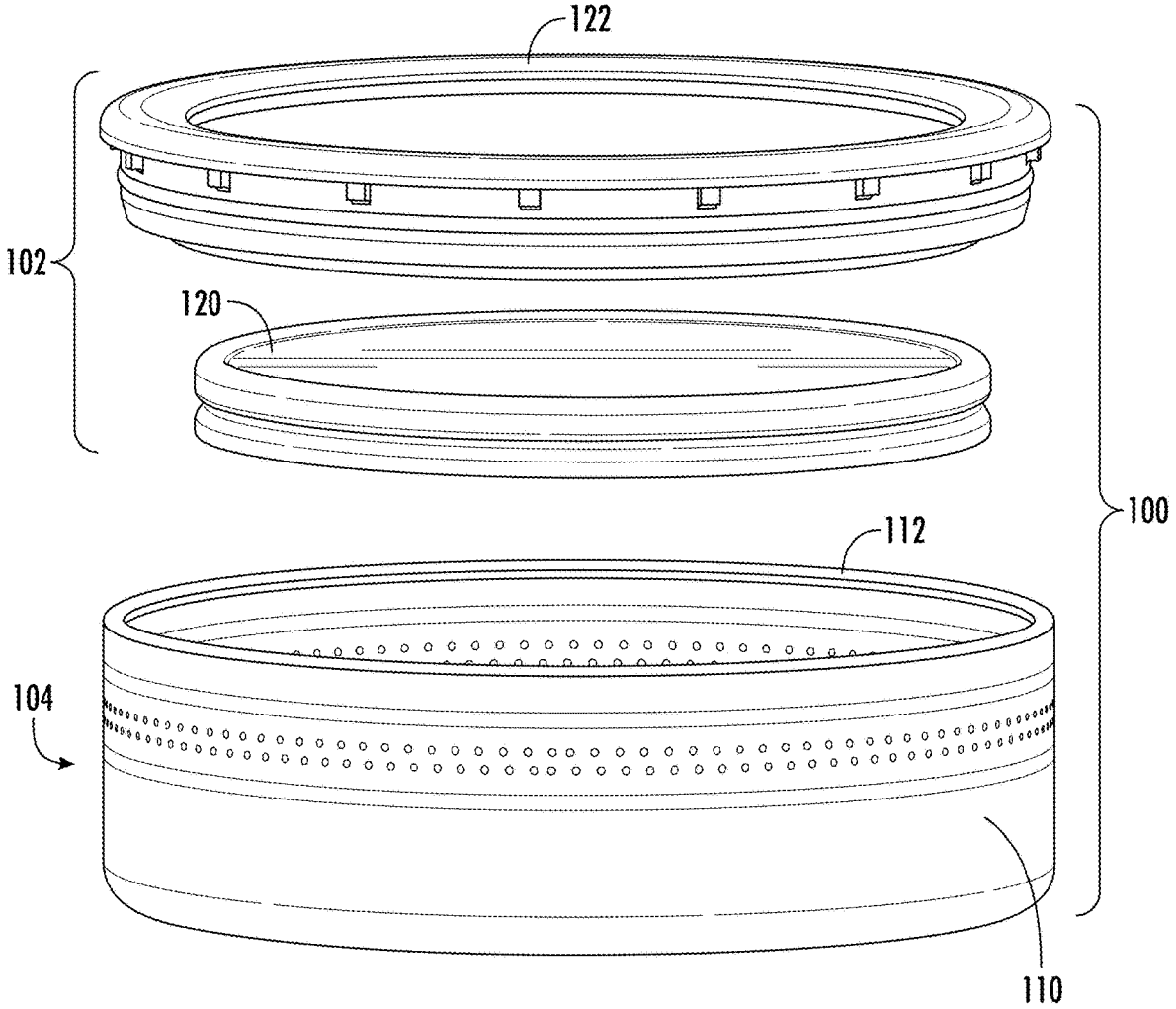
FIGS. 2 and 3 are perspective exploded illustration of the container of FIG. 1.
Figure 3:
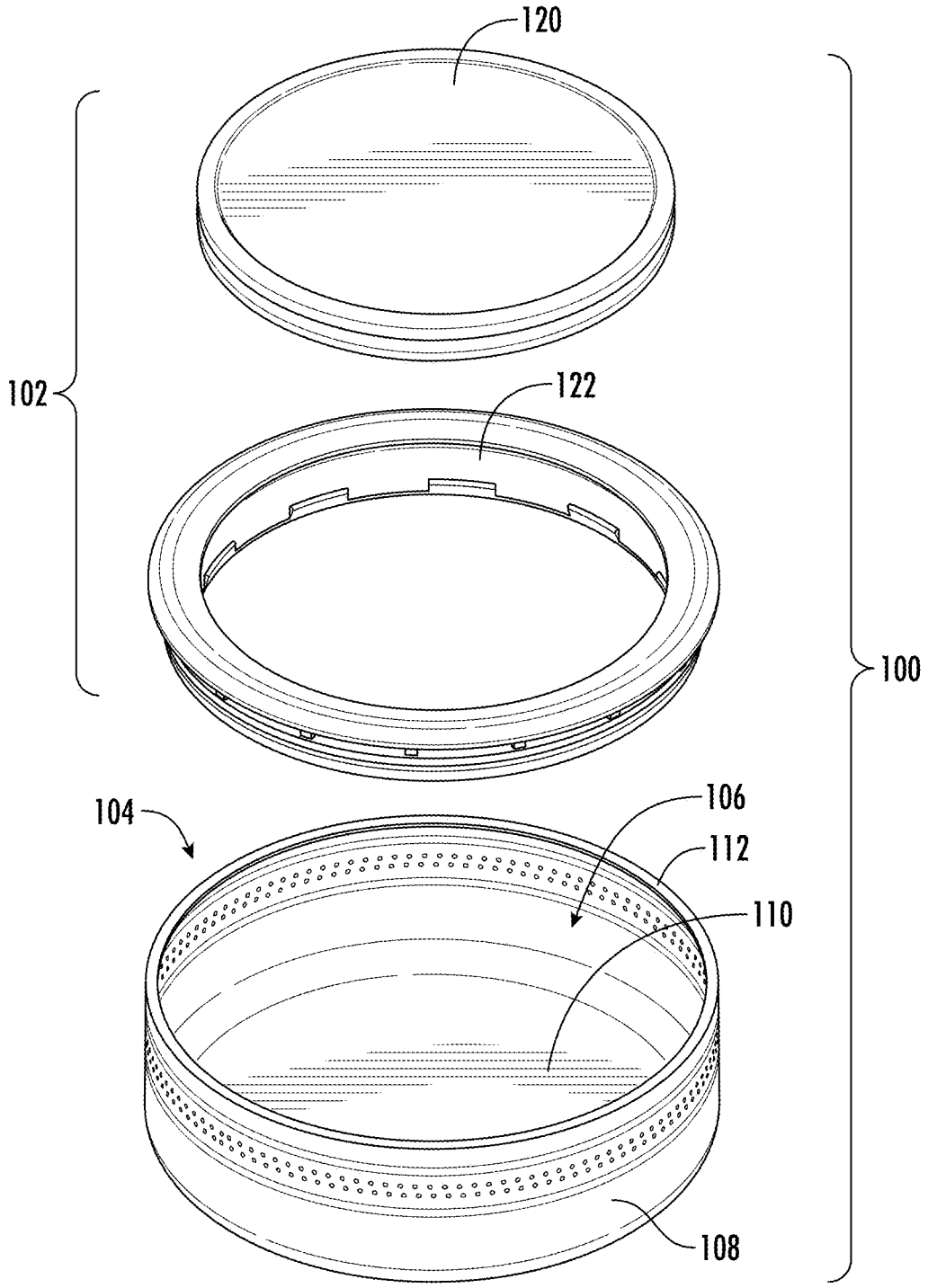
Figure 4:
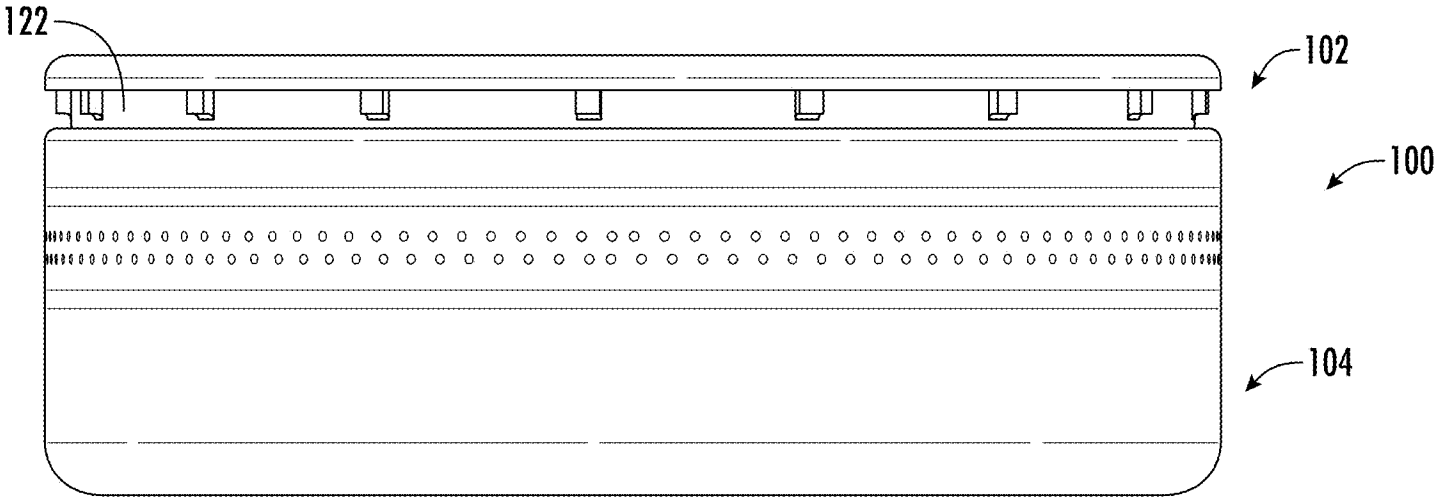
FIG. 4 is a side view of the container of FIG. 1 with the lid slightly offset from its mounted position.

FIG. 1 illustrates an example of a container 100. The container 100 generally includes a lid 102 and a container bottom 104. The lid 102 is releasably attachable to the container bottom 104 to provide selective access to a storage compartment 106 of the container bottom 104.

In one example, the lid 102 is snap engaged with the container bottom 104. In other examples, the lid 102 is friction fit engaged with the container bottom 104.

While illustrated as round, other shapes such as rectangular other polygonal shapes or non-polygonal shapes are contemplated. The term annular shall include other shapes other than round.

Further, the container 100 may have particular use with products such as traditional tobacco, tobacco with no nicotine, a product that does not have tobacco but that includes nicotine, a product that has no tobacco and no nicotine, etc. The container could be used for other products such as candy, medicine, lozenges, etc.

In the illustrated example, the container bottom 104 is a metal component having an annular bottom sidewall 108 that extends from a bottom wall 110. In the illustrated example, the container bottom 104 has a radially inward extending projection in the form of a radially inward extend curl 112 that is a radially inward curled portion of the bottom sidewall 108. The curl 112 forms the distal end of sidewall 108.

In the illustrated example, the bottom wall 110, bottom sidewall 108, and curl 112 are formed from a single continuous piece of material and particularly metal. The container bottom 104 may be formed from stamped sheet metal such as aluminum.

The curl 112 defines a mouth 111 to the storage compartment 106.

The lid 102 is a multicomponent lid that includes a metal lid component 120 and a connection ring 122. In one example, the connection ring 122 is formed from plastic.

The connection ring 122 is configured to releasably engage the container bottom 104. This allows the lid 102 to be selectively attached and disconnected from the container bottom 104.

In this example, the connection ring 122 is in the form of an adaptor ring used to connect an existing lid to a different container bottom. In particular, the connection ring 122 may be used to connect a preexisting lid to a newly sized container bottom. In the past, the lid component, which is a lid, would axially receive an end of the sidewall of the container bottom. For example, the lid component 120 may be constructed as described in U.S. Pat. No. 9,205,959, which is incorporated herein by reference thereto. The present lid component 120 can have dimensions and shape as described in U.S. Pat. No. 9,205,959.

Figure 5:
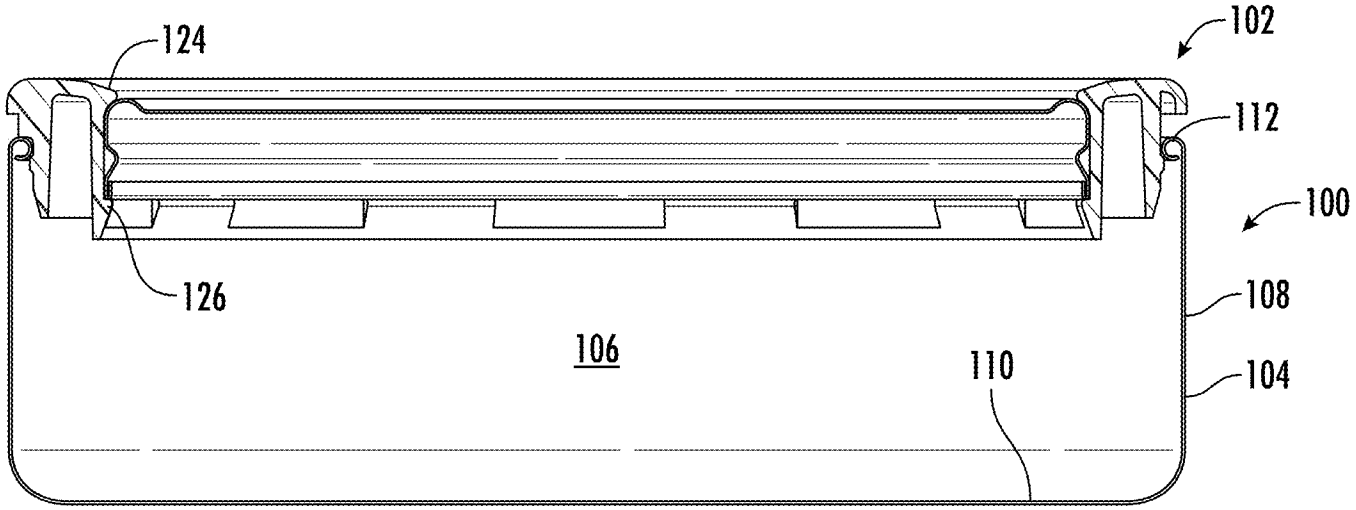
FIG. 5 is a cross-sectional illustration of the container of FIG. 1.
Figure 6:
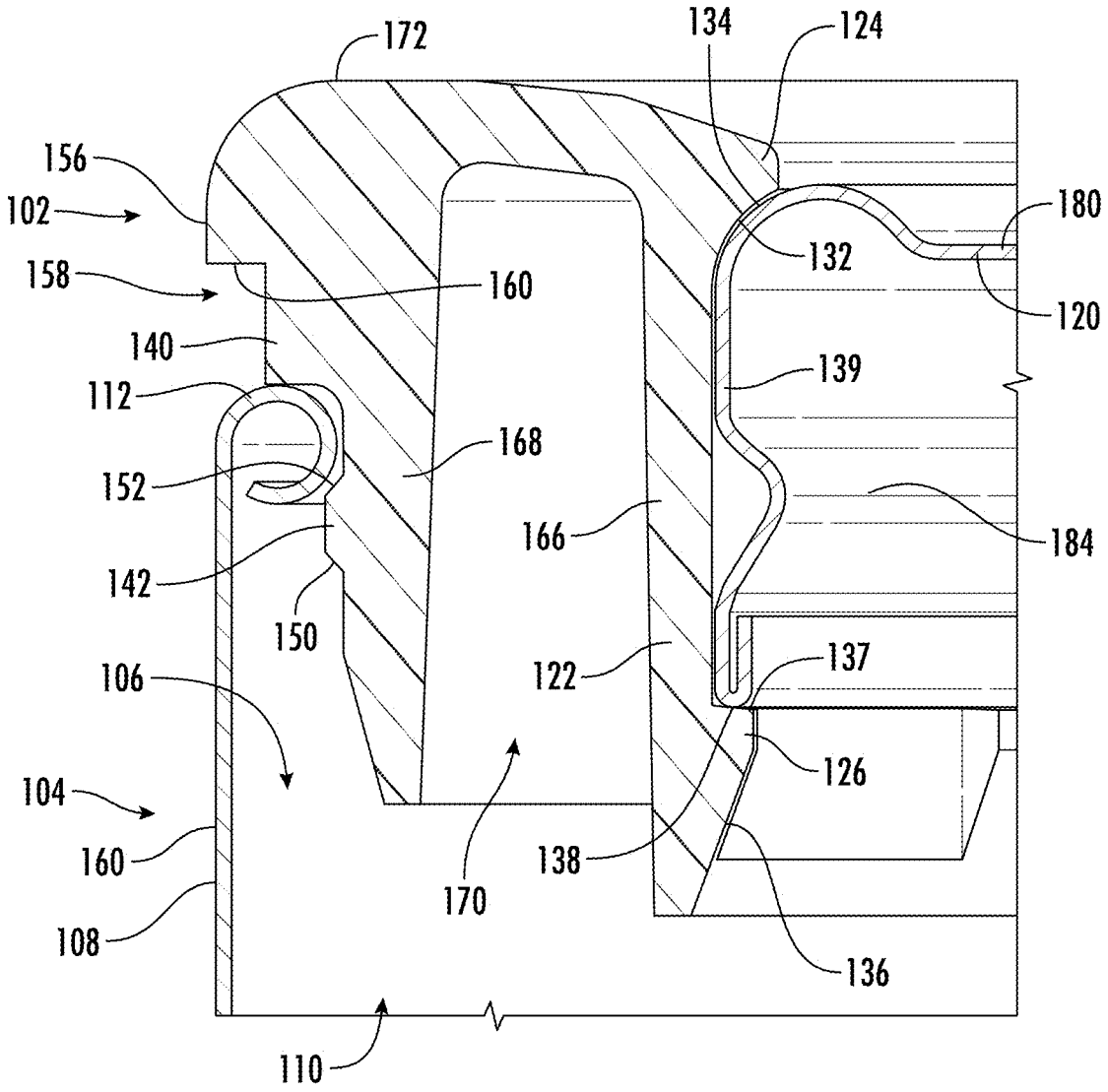
FIG. 6 is an enlarged partial cross-sectional illustration illustrating the connection of the lid to the container bottom of the container of FIG. 1.
Figure 7:
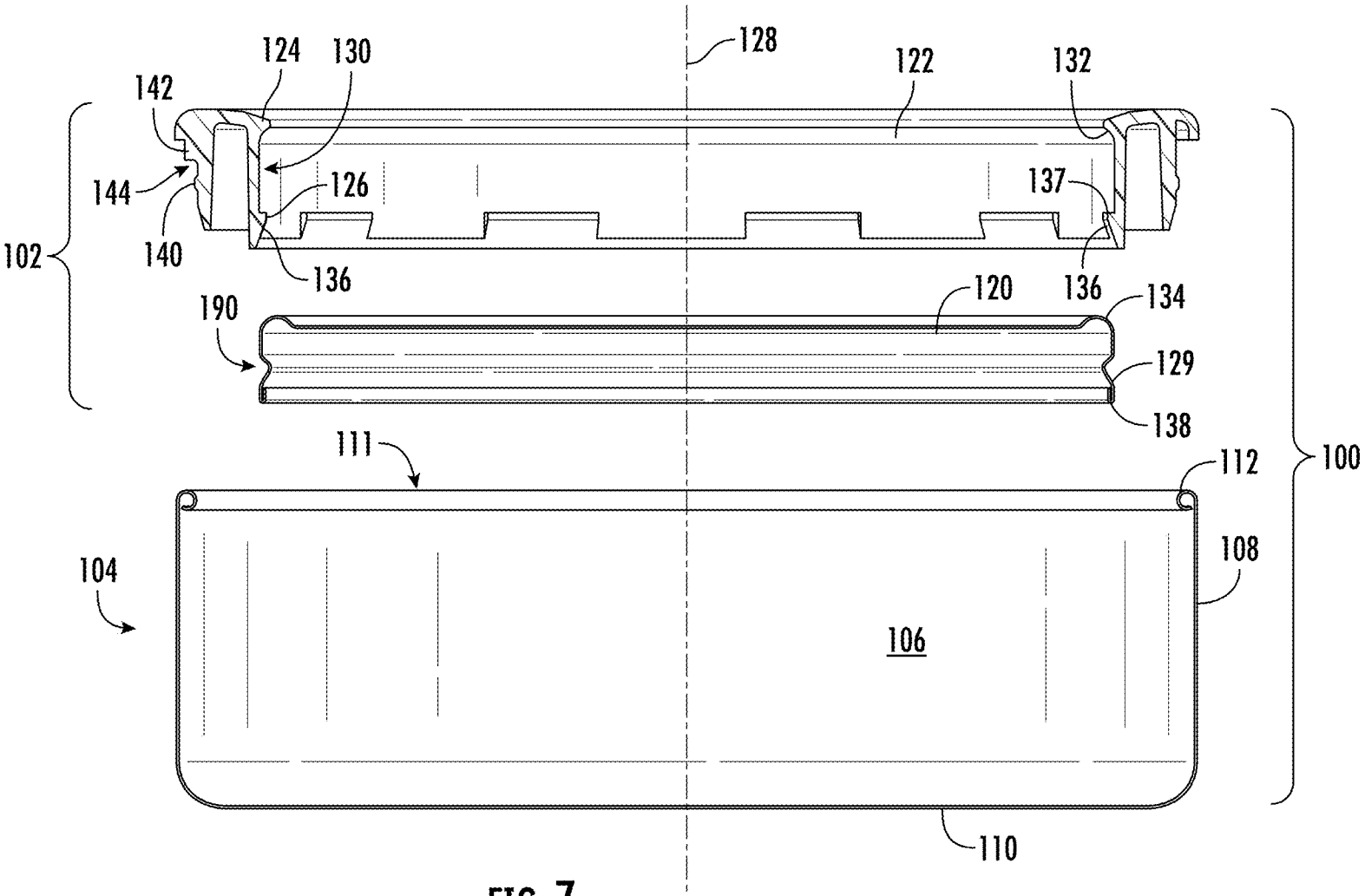
FIG. 7 is an exploded cross-sectional illustration of the container of FIG. 1.
Figure 8:
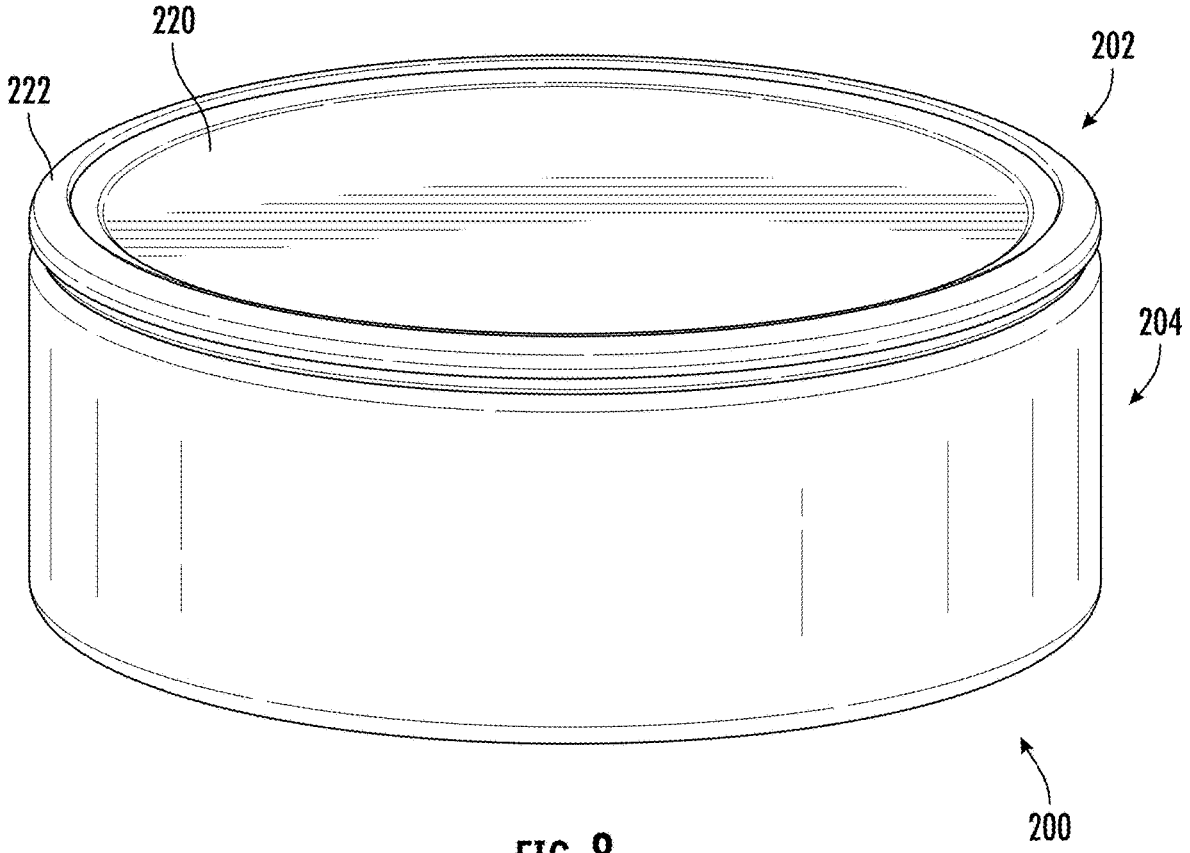
FIG. 8 is a perspective illustration of a second example of a container.
Figure 9:
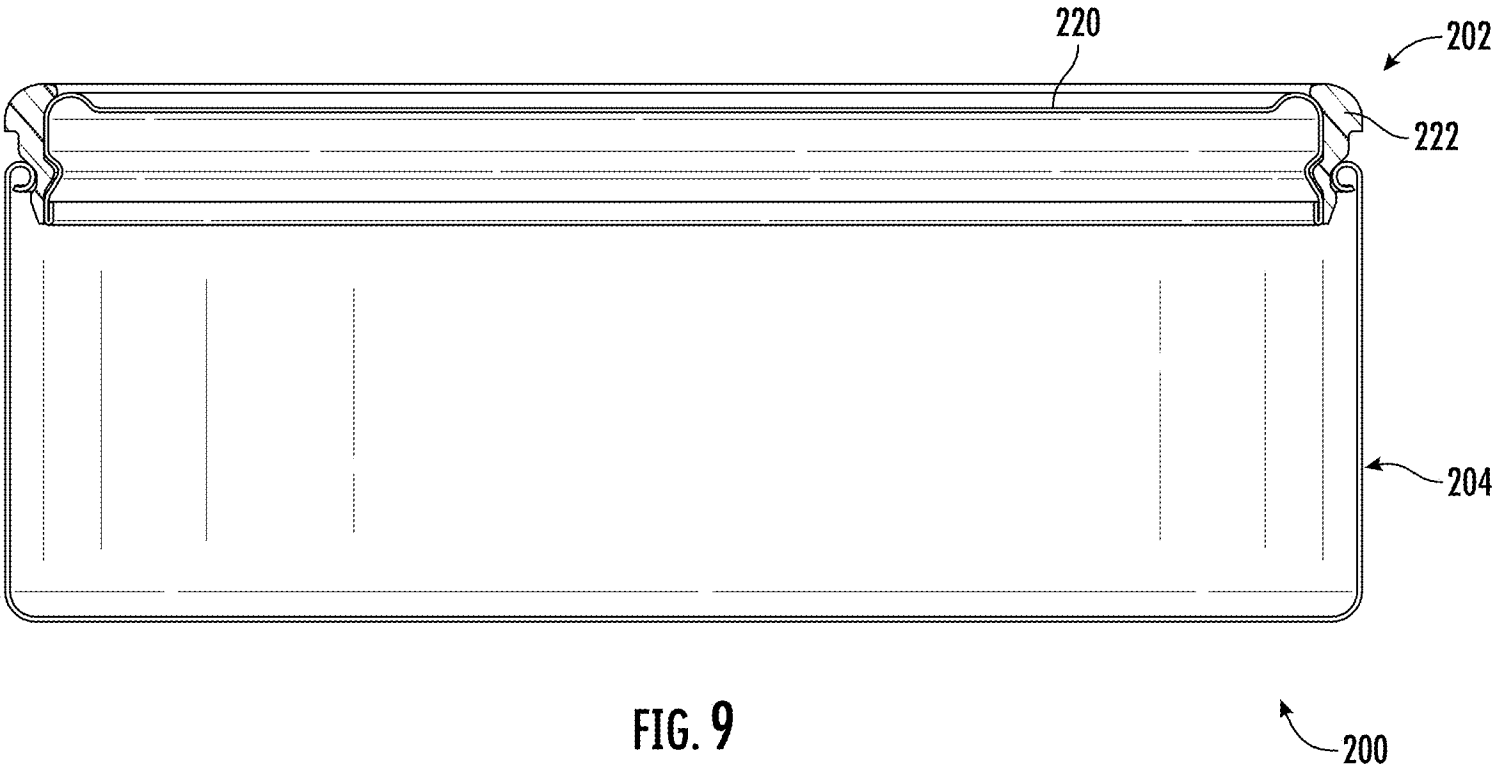
FIG. 9 is a cross-sectional illustration of the container of FIG. 8 with the lid attached to the container bottom.
Figure 10:
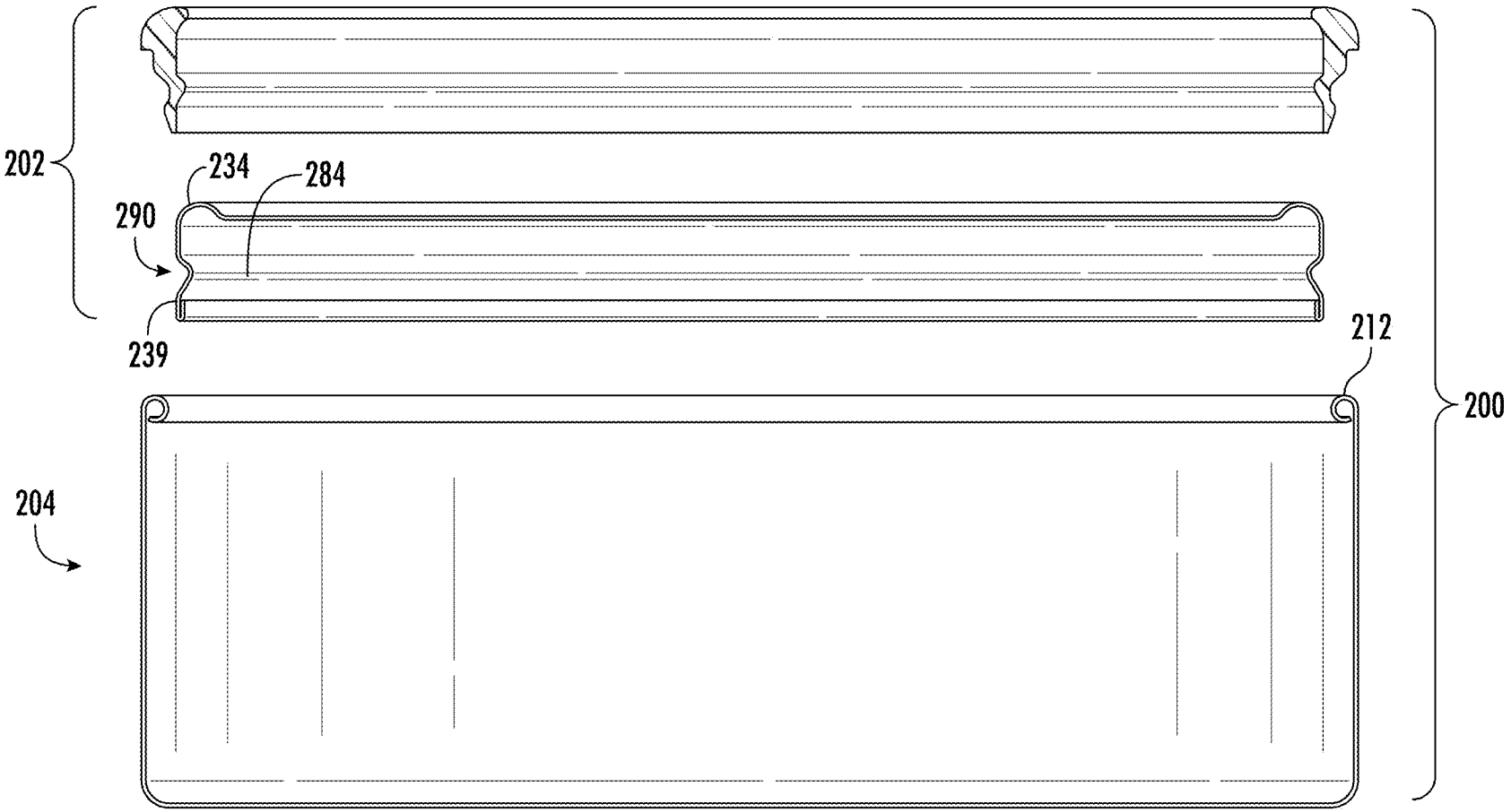
FIG. 10 is an exploded cross-sectional illustration of the container of FIG. 8.
Figure 11:
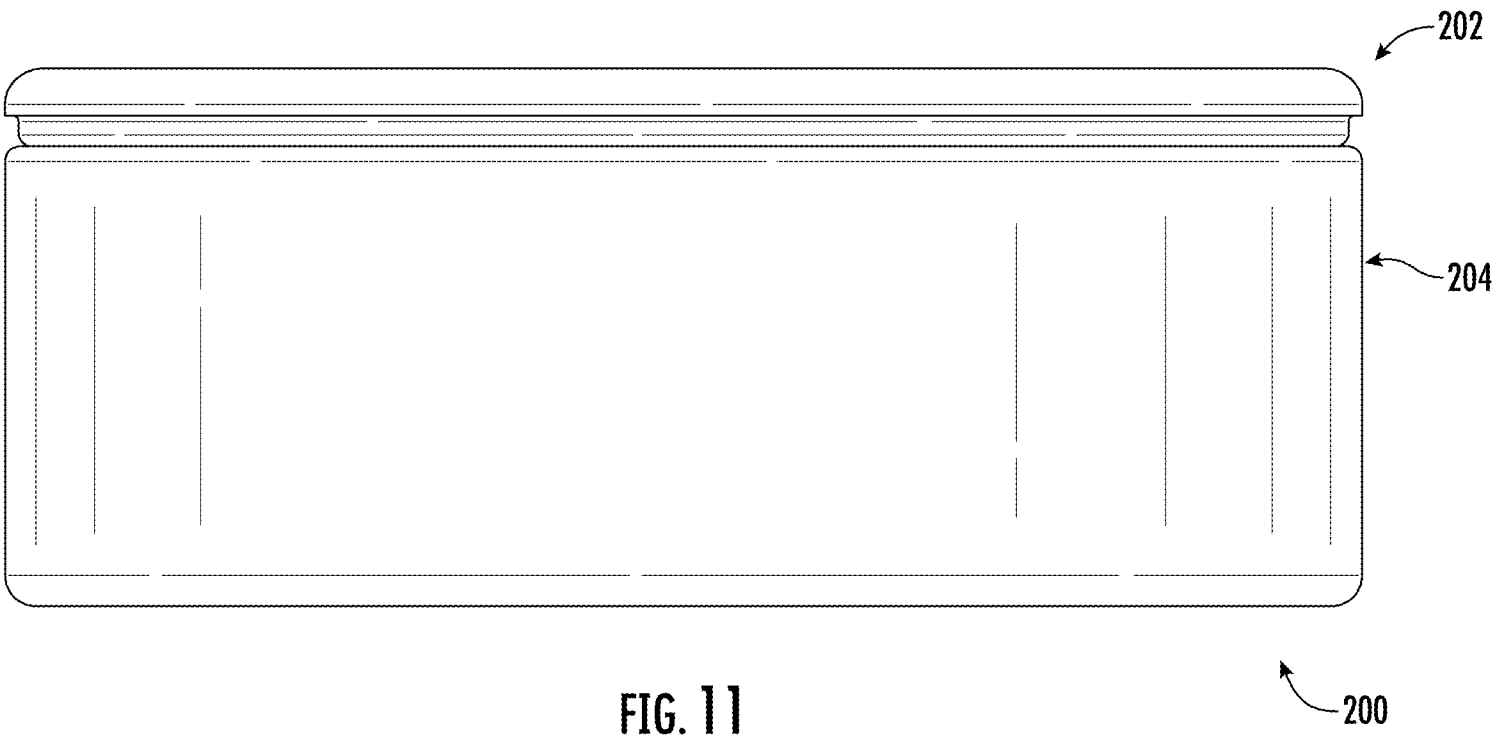
FIG. 11 is a side view of the container of FIG. 8.
Figure 12:
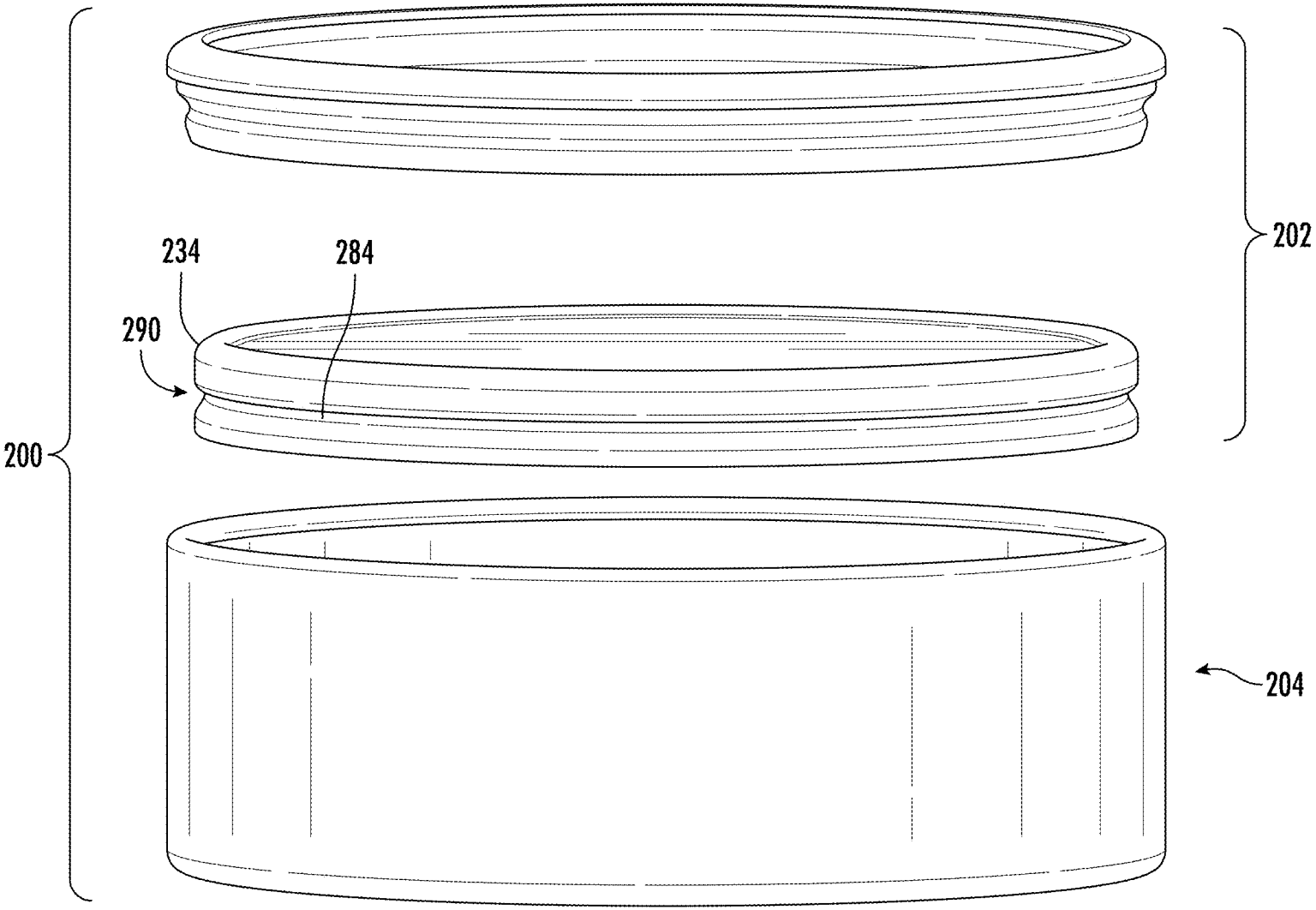
FIG. 12 is an exploded illustration of the container of FIG. 8.

The metal lid component 120 is mechanically attached to connection ring 122. With reference to FIGS. 5-7, the connection ring includes first and second radially inward extending catches 124, 126. The first and second radially inward extending catches 124, 126 are axially spaced from one another parallel to central axis 128 forming a gap 130 therebetween. Gap 130 receives a portion of the metal lid component 120 therein.

In this example, the second radially inward extending catch 126 is discontinuous and is formed from a plurality of inward extending projections that are angularly spaced apart about axis 128.

The first radially inward extending catch 124 is continuous about axis 128. An axially inward facing surface 132 is shaped and sized to the shape and size of shoulder 134 of the metal lid component 120.

The second radially inward extending catch 126 has a tapered surface 136 that acts to permit insertion of the metal lid component 120 into the connection ring 122. Opposite surface 136 is abutment surface 137 configured to engage a distal end 138 of a sidewall 139 of the metal lid component 120. In this example, the abutment surface 137 is more orthogonal to axis 128 than tapered surface 136.

The inner diameter of the opening defined by the inner edge of the first radially inward extending catch 124 is smaller than the inner diameter of the opening defined by the inner edge of the second radially inward extending catch 126 (e.g. the diameter defined by the inner edge of the projections forming catch 126).

The connection ring 122 has first and second radially outward extending catches 140, 142 that are axially spaced apart forming a gap 144 therebetween. The first and second radially outward extending catches 140, 142 cooperate with the container bottom 104 to secure the lid 102 to the container bottom 104. In this example, the curl 112 of the container bottom 104 is radially received within gap 144 axially between the first and second radially outward extending catches 140, 142.

The first radially outward extending catch 140 extends radially outward further than the second radially outward extending catch 142. As such, the outer diameter of the first radially outward extending catch 140 is greater than the outer diameter of the second radially outward extending catch 142.

The first radially outward extending catch 140 is discontinuous and provided by a plurality of radially outward extending projections while the second radially outward extending catch 142 is a continuous rib.

In this example, the second radially outward extending catch 142 has opposed tapered surfaces 150, 152. Surface 150 assists in attaching the connection ring 122 to curl 112 when the lid 102 is attached to the container bottom 104 while surface 152 assists in detaching the connection ring 122 when the lid 102 is removed from container bottom 104. In this example, the surfaces 150, 152 have a similar taper angle relative to central axis 128.

In this example, the outer surface of the first radially outward extending catch 140 and the corresponding projections is positioned radially inward from an outer radial peripheral surface 156 of the connection ring 122. This provides a gap 158 formed axially between the distal end of the container bottom 104 and particularly curl 112 thereof and surface 160. This provides a location for a user to engage the connection ring 122 to remove the lid 102 from the container bottom 104.

However, in a preferred example, the outer peripheral surface 156 is configured to align with the outer peripheral surface 160 of sidewall 108 of the container bottom 104. Preferably, the outer diameter of the outer peripheral surface 156 is plus or minus 10% of the outer diameter of the outer peripheral surface 160.

In this example, the connection ring 122 includes a pair of annular sidewalls 166, 168 with an annular gap 170 formed radially therebetween. The first and second radially inward extending catches 124, 126 extend radially inward from the first annular sidewall 166 and the first and second radially outward extending catches 140, 142 extend radially outward from the second annular sidewall 168.

The connection ring 122 provides an axially outermost extent of the container 100. In particular, the metal lid component 120 is spaced axially inward from an outermost end 172 of the connection ring 122 and assembled container 100.

The first and second radially inward extending catches 124, 126 are axially spaced apart a greater distance than the first and second radially outward extending catches 140, 142. The first and second radially inward extending catches 124, 126 straddle the first and second radially outward extending catches 140, 142 such that the catches 140, 142 are positioned between the surfaces 132, 137.

In this example, the metal lid component 120 has a top wall 180 from which annular sidewall 139 axially extends. This provides a cup-shaped configuration. Shoulder 134 connects the annular sidewall 139 to the top wall 180. As this component is a prior metal lid, as discussed above, it includes a radially inward extending bead 184 configured to attach the component to a container bottom having a radially outward extending catch. Other examples need not include the bead 184. However, the connection ring 122 provides the ability to adapt such a lid to a different container bottom, such as the one illustrated in the instant application that has a diameter that is larger than the largest diameter of the lid component 120.

In this example, at least a portion of sidewall 139 is axially received within the storage compart 110 of the container bottom 104. Here, when the lid 102 is attached to the container bottom 104, the mouth defined by curl 112 is positioned axially between shoulder 134 and distal end 138 of the metal lid component 120. Similarly, second radially inward extending catch 126 is positioned within the container bottom 104.

FIGS. 8-13 illustrate a further example of a container 200. The container 200 includes a lid 202 and a container bottom 204 with the lid 202 formed from a metal lid component 220, which is the same as metal lid component 120, and a connection ring 222. The container bottom 204, in this example, is the same as the container bottom 104 of the prior example.

Figure 13:
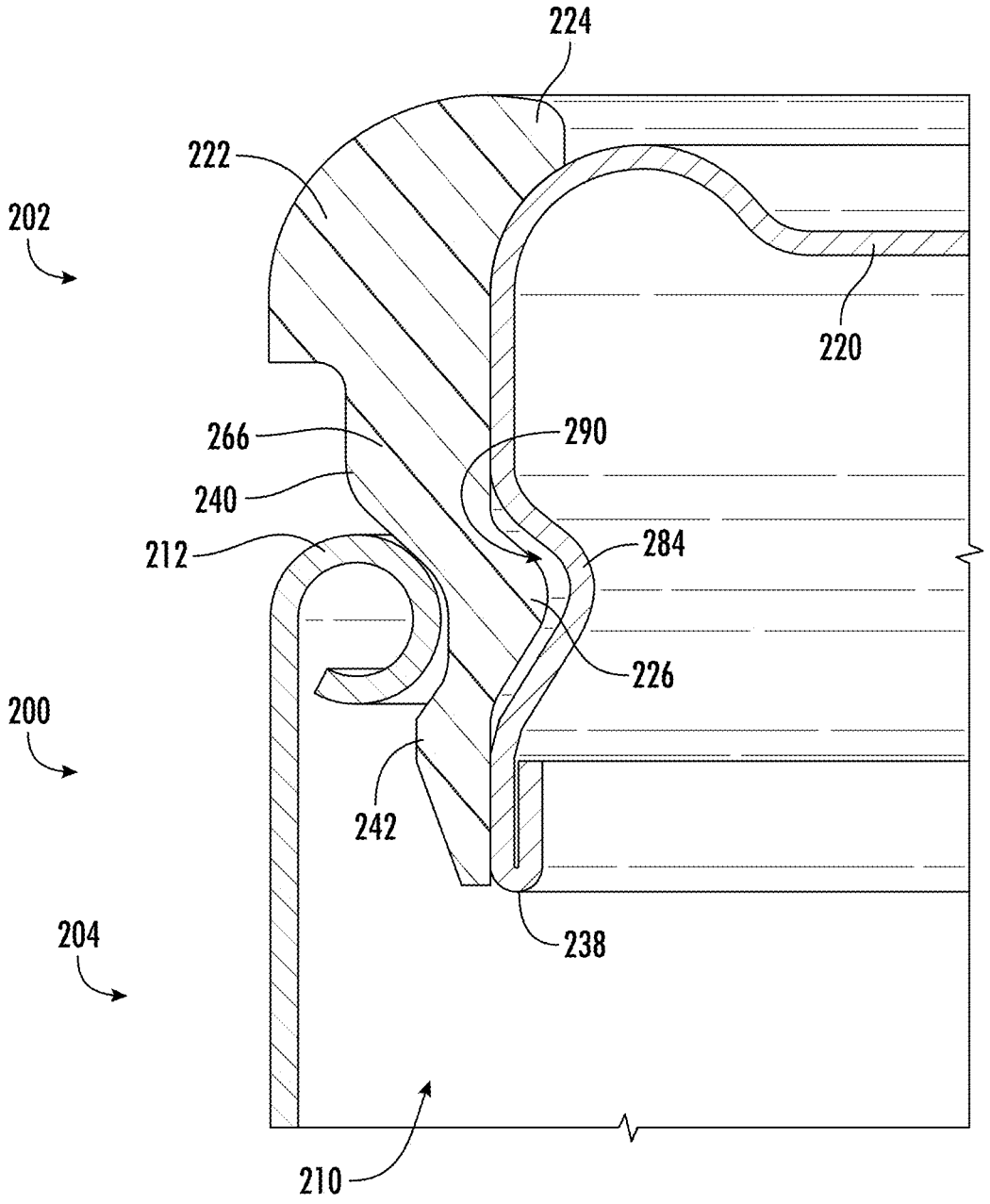
FIG. 13 is an enlarged partial cross-sectional illustration illustrating the connection of the lid to the container bottom of the container of FIG. 8.
Figure 14:
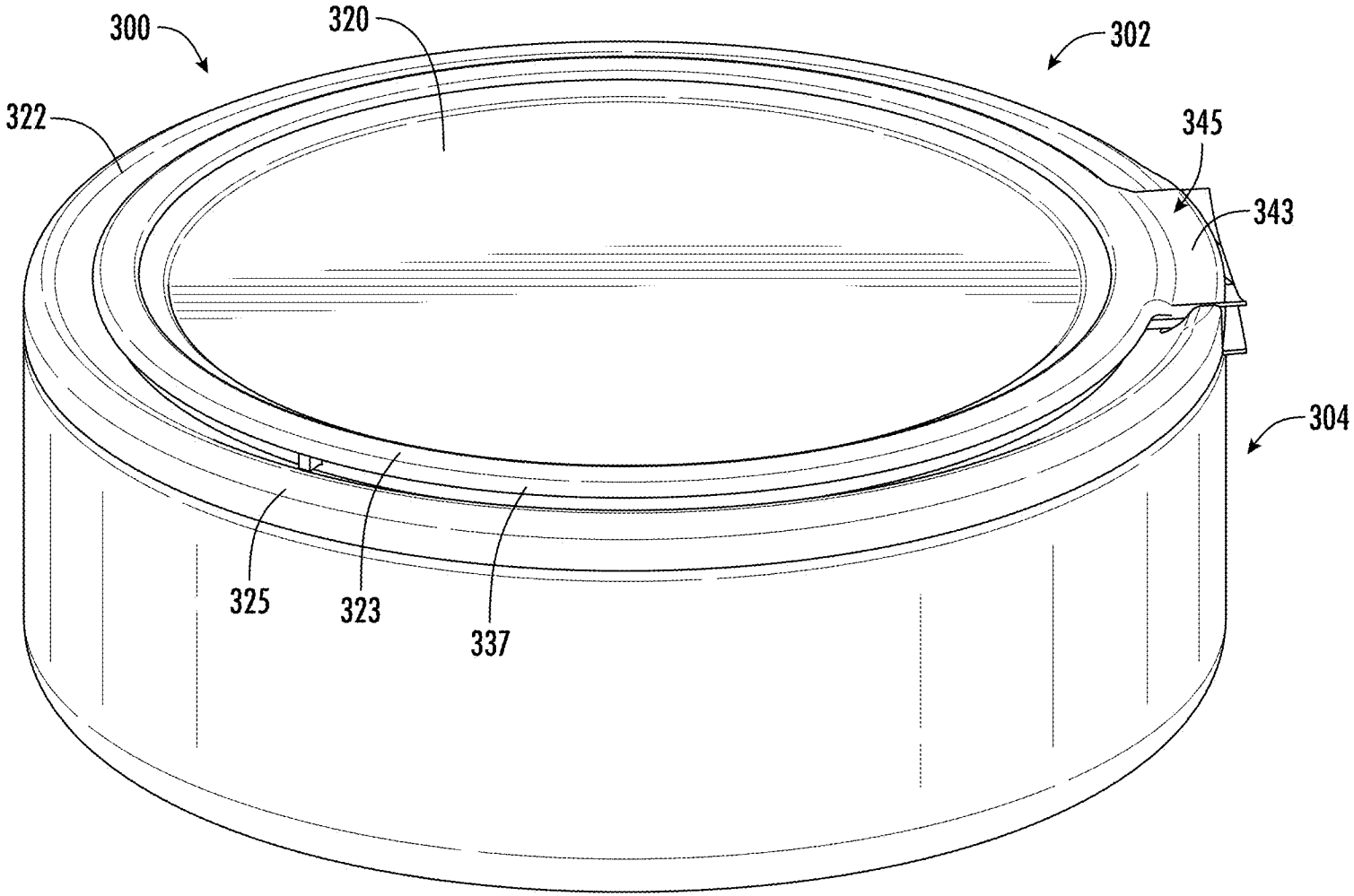
FIG. 14 is a perspective illustration of a further example of a container.

With reference to FIG. 13, the connection ring 222 has a different configuration than connection ring 122. In this example, only a single sidewall 266 is provided.

Here, the first and second radially inward extending catches 224, 226 are formed on a first side of sidewall 266 and the first and second radially outward extending catches 240, 242 are formed on the opposed side.

Rather than engaging distal end 238, connection ring 222 engages the groove 290 formed by the radially inward extending bead 284. In particular, second radially inward extending catch 226 extends into groove 290.

While first radially inward extending catch 224 is configured similar to catch 124 and extends over shoulder 234, in this example, the engagement of catch 226 with groove 290 is all that would be required to secure the two components to one another.

This example illustrates that the radially extending catches 224, 226, 240, 242 can be continuous structures rather than angularly spaced segments as in catches 126, 140 described above.

FIGS. 14-19 illustrate a further example of a container 300. The container 300 includes a lid 302 and a container bottom 304 with the lid 302 formed from a metal lid component 320, which is the same as metal lid component 120, 220 and a connection ring 322. The container bottom 304, in this example, is the same as the container bottom 104, 204 of the prior examples.

Figure 15:
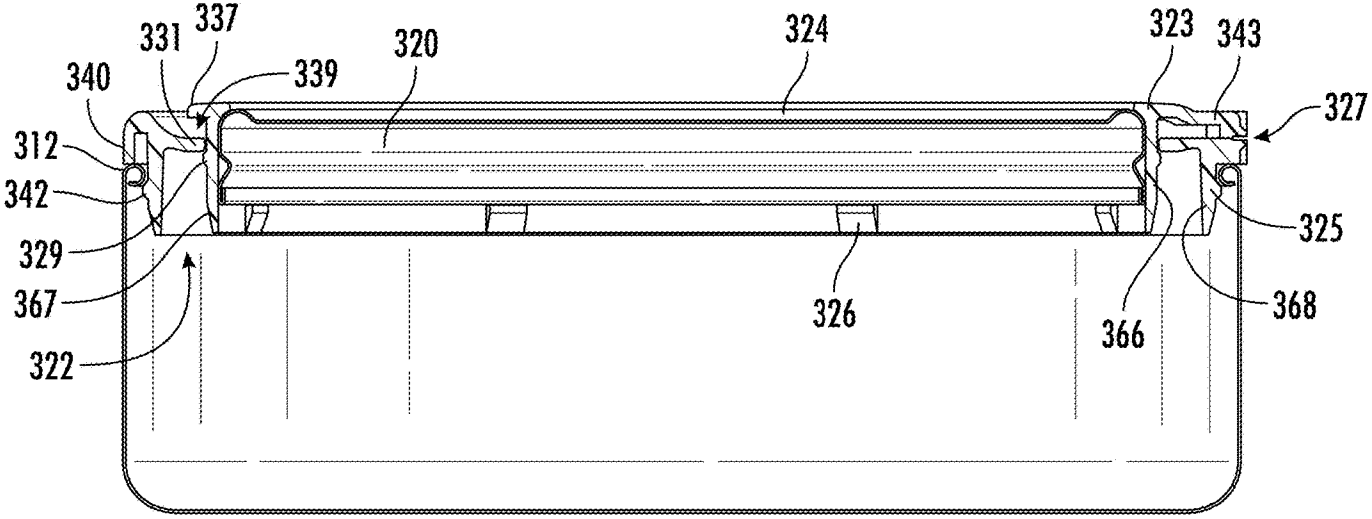
FIG. 15 is a cross-sectional illustration of the container of FIG. 14 in a closed orientation.
Figure 16:
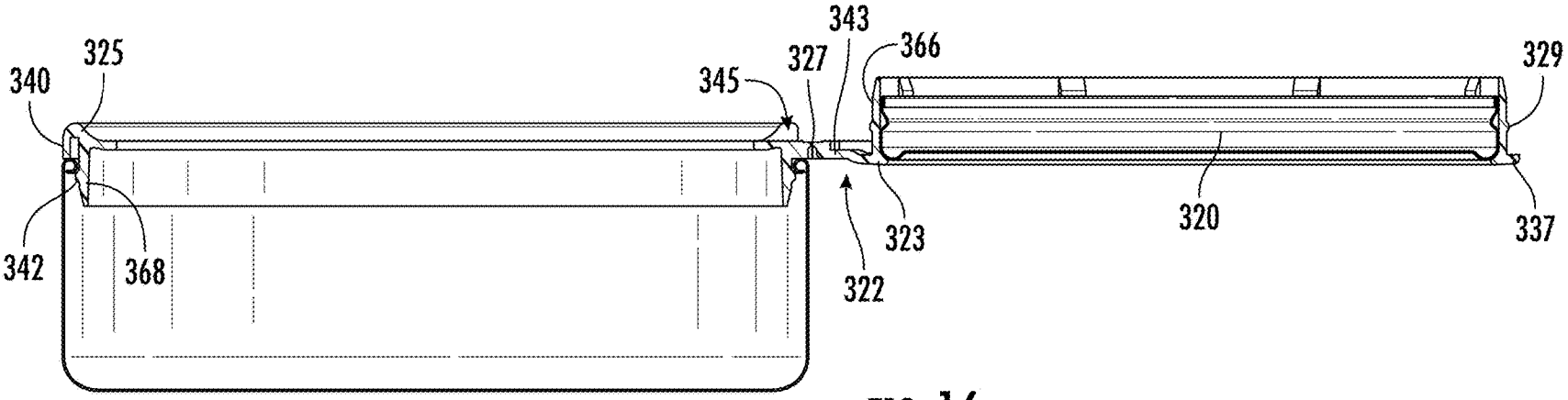
FIG. 16 is a cross-sectional illustration of the container of FIG. 14 in an open orientation.
Figure 17:
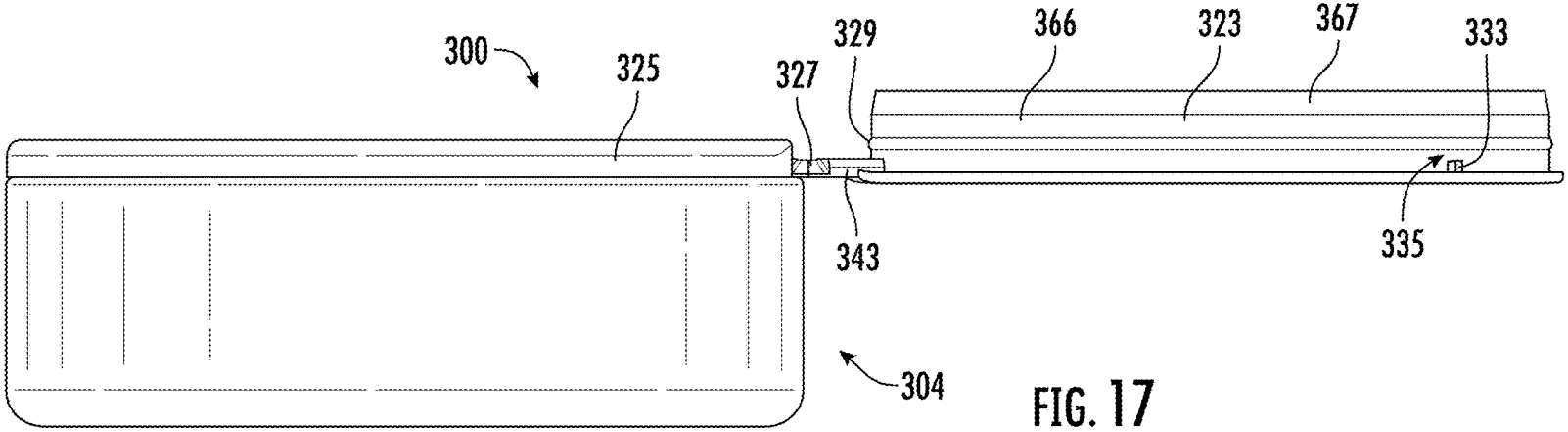
FIG. 17 is a profile illustration of the container of FIG. 14 in the open orientation.

With reference to FIGS. 15-16, in this example, the connection ring 322 allows for hinged opening of the container 300. In particular, the connection ring 322 includes a first portion 323 that is hingedly attached to a second portion 325 by living hinge 327.

In this example, the metal lid component 320 is attached to the first portion 323 in a similar manner as in the prior examples. In particular, the metal lid component 320 is snap engaged with the first portion 323 radially extending catches 324, 326 that extend radially inward relative to annular sidewall 366.

The second portion 325 attaches the connection ring 322 to the metal container bottom 304 similar to the prior examples. In this example, the second portion 325 has annular sidewall 368 that has radially outward extending catches 340, 342 that cooperate with curl 312 to secure the connection ring 322 to the container bottom.

The first portion 323 may friction or snap engage second portion 325 when in the closed orientation (see FIG. 15) to secure the first portion 323 in the closed orientation relative to second portion 325. In this example, the annular sidewall 366 includes radially outward extending catch 329 that axially engages radially inward extending catch 331 of the second portion 325 to maintain the two portions in the relative closed orientation.

In this example, catch 331 is a continuous annular flange.

In a particular example, the outer periphery of sidewall 366 provides a level of sealing with the inner periphery of the annular flange that forms catch 331.

In other examples, the inner diameter of catch 331 may be smaller than or substantially equal to the outer diameter of annular sidewall 366 such that a mere friction engagement secures the two portions 323, 325 in the closed orientation.

In this example, the distal end of the annular sidewall 366 includes a taper 367 that assists in transitioning from an open orientation, see e.g. FIG. 16, to the closed orientation of FIG. 15. The entire height of the annular sidewall 366 (e.g. the outer periphery thereof) may be tapered or only a portion of the vertical height as in the illustrated example.

The first portion 323 includes axial standoffs 333 positioned radially outward of sidewall 366 that abut an outer surface 335 of catch 331. In this example, the axial standoffs 333 are radially connected to and radially outwardly extending from sidewall 366. Thus, catch 331 is positioned axially between catch 329 and standoff 333 within gap 335 (see FIGS. 17 and 18) when in the closed orientation for this example that uses a snap engagement rather than merely friction fit.

The first portion 323 includes a radially outward extending flange portion 337 that extends radially outward beyond sidewall 366. The flange portion 337 is axially spaced from a top surface of catch 331. This provides a finger gap 339 that is engageable by a user to allow for opening. In this example, the finger gap 339 extends at least 75 percent of the circumference of first portion 323.

Figure 18:
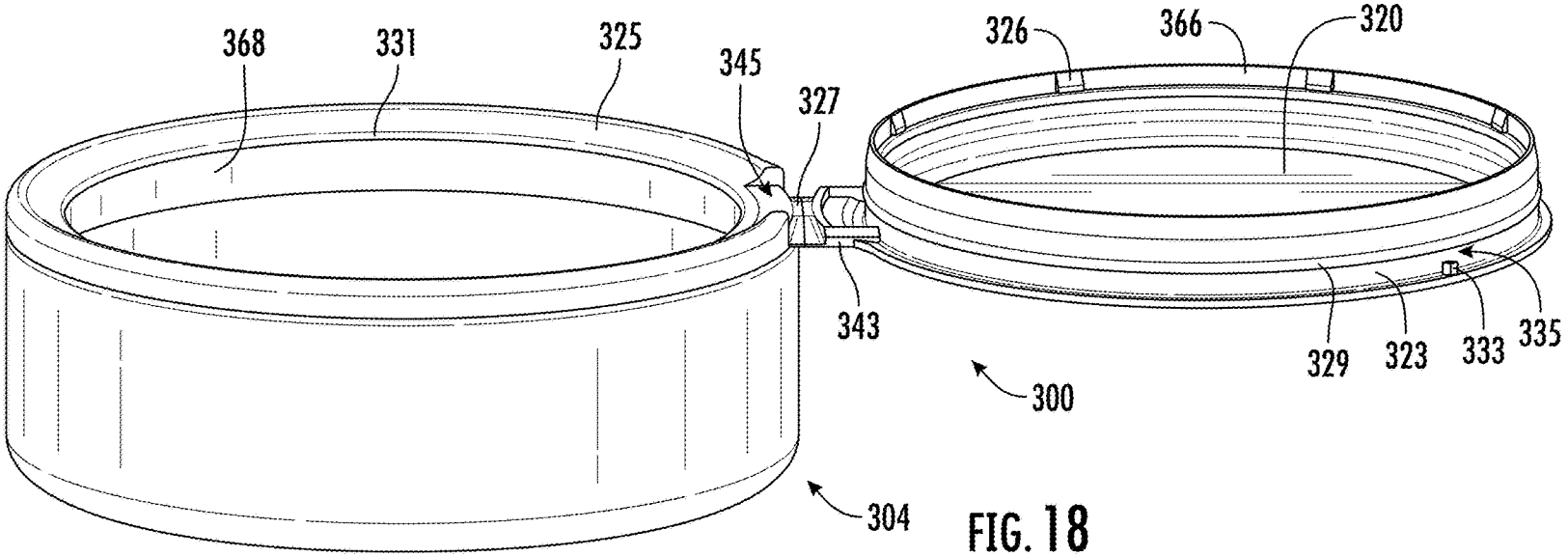
FIG. 18 is a perspective illustration of the container of FIG. 14 in the open orientation.
Figure 19:
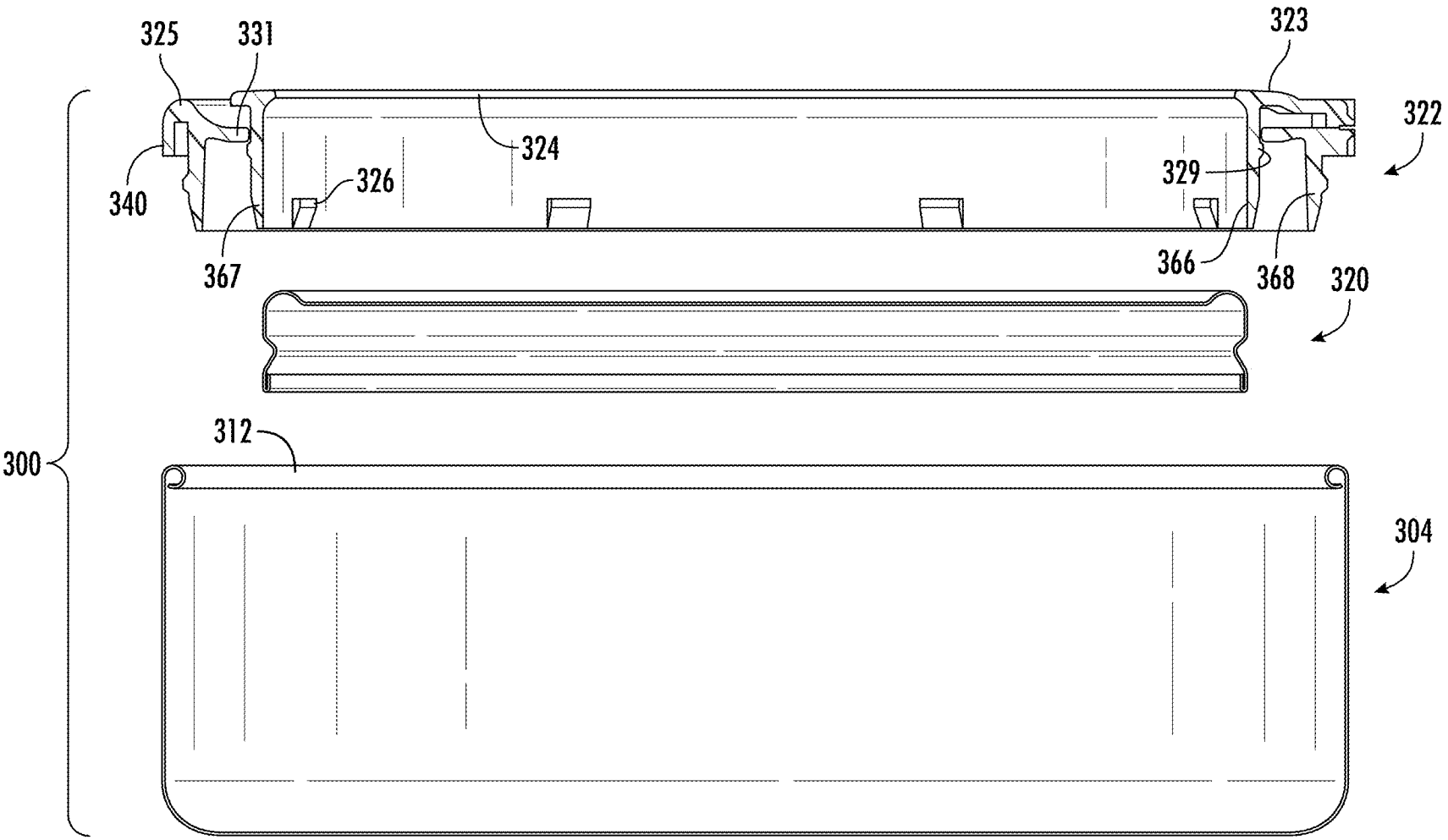
FIG. 19 is an exploded, cross-sectional illustration of the container of FIG. 14.

In one example, the flange portion 337 extends radially outward beyond standoffs 333 (see FIG. 18).

To allow for the hinged connection between the first and second portions 323, 325, the first component has a radially extending portion 343 that connects to the second portion 325. To accommodate portion 343 when in the closed orientation, the second portion 325 includes a notch 345 in an upper shoulder region thereof.

Figure 20:
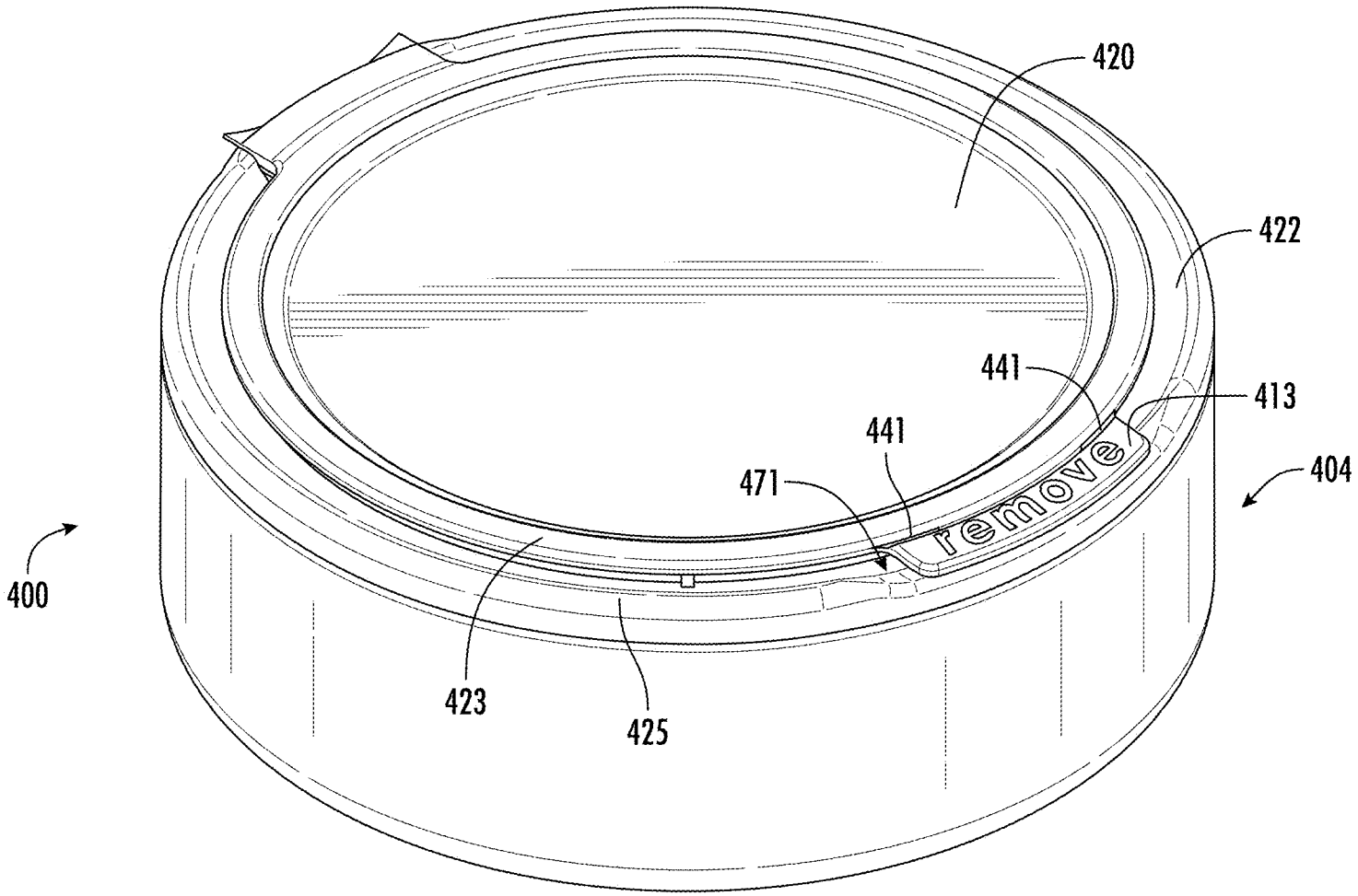
FIG. 20 is a perspective illustration of a further embodiment of a container.
Figure 21:
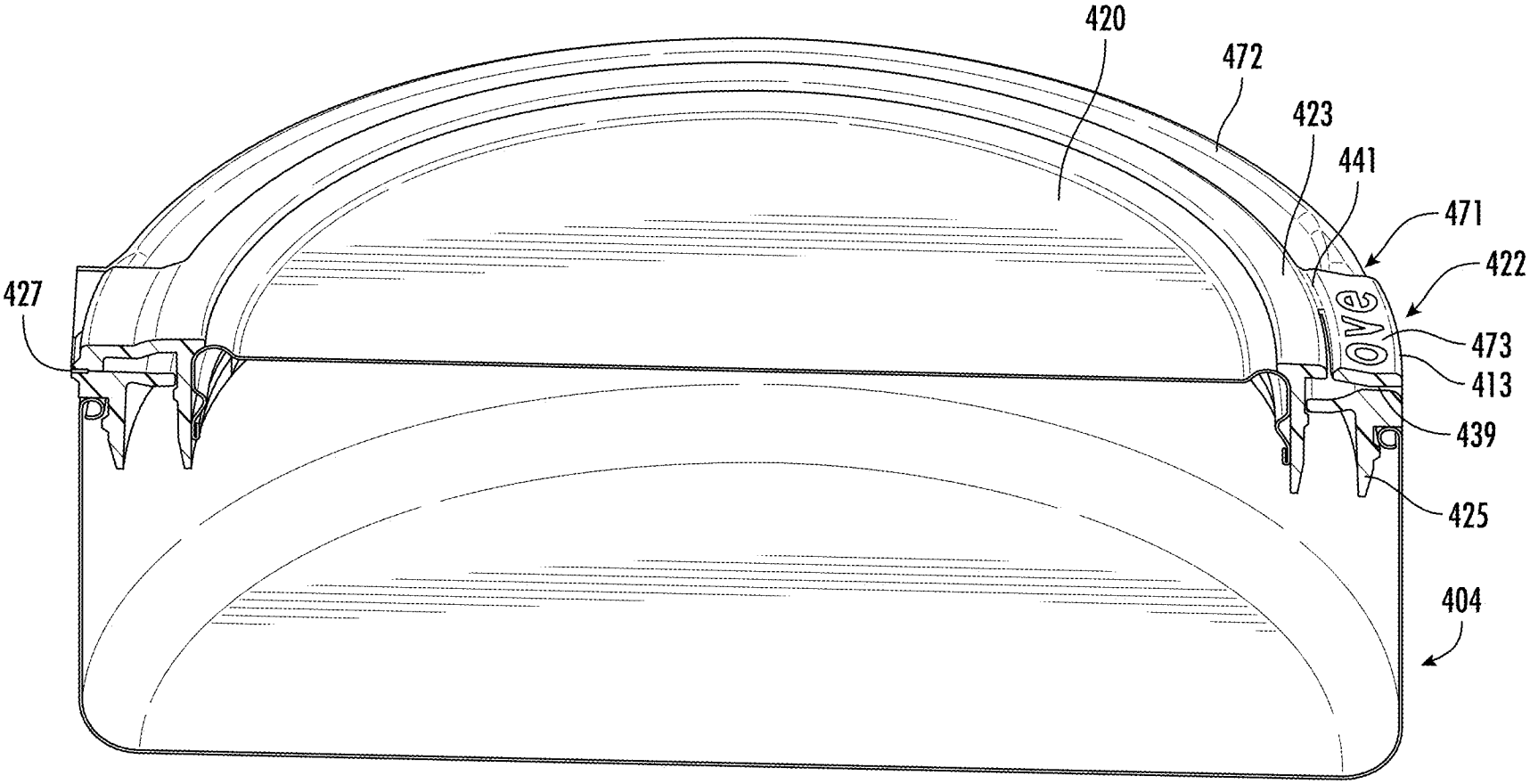
FIG. 21 is a cross-sectional illustration of the container of FIG. 20.
Figure 22:
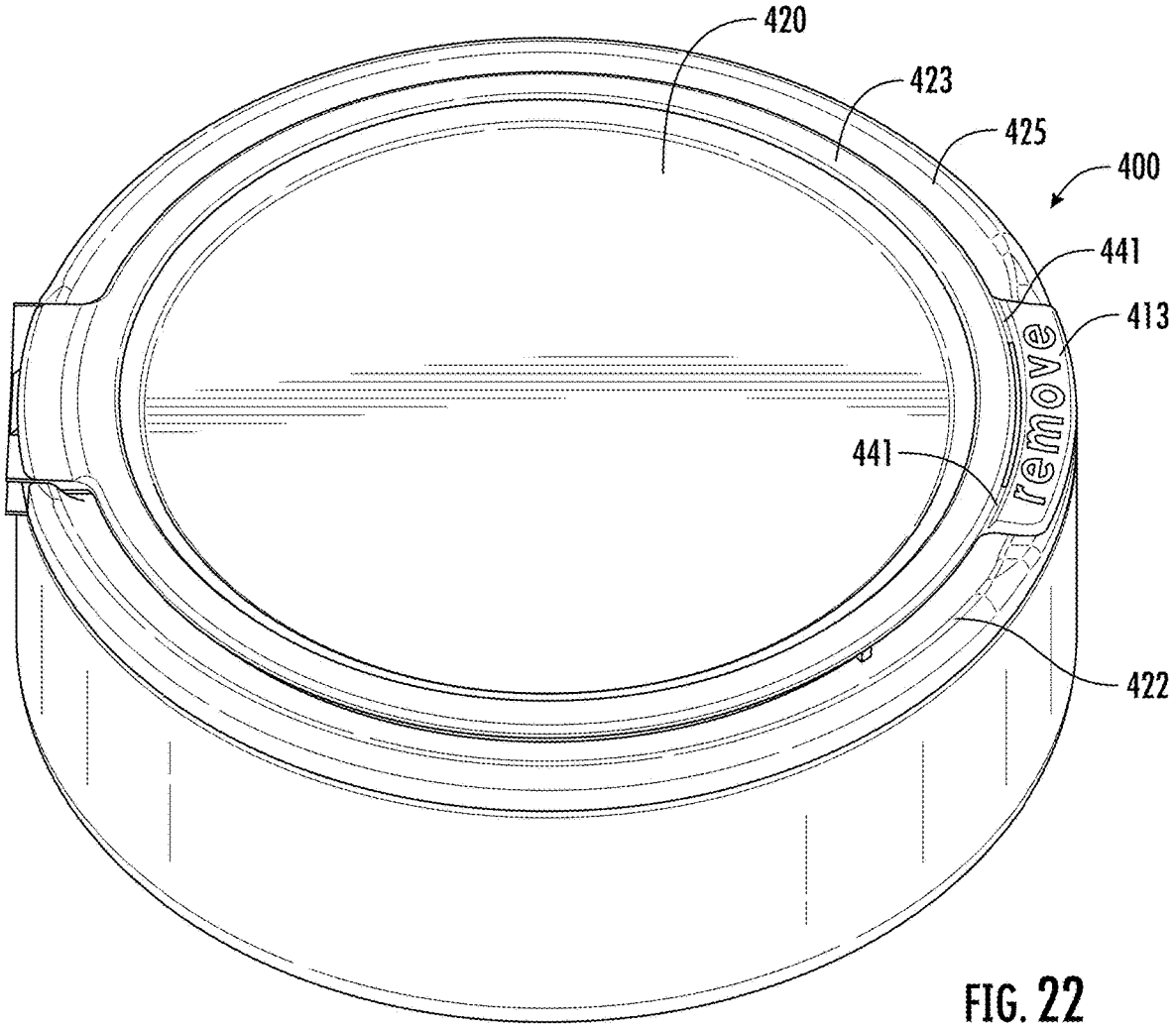
FIG. 22 is a further perspective illustration of the container of FIG. 20.

FIGS. 20-22 illustrate a further embodiment of a container 400 that is substantially similar to container 300. However, this example has tamper evidence features. In particular, a tamper evidence strip 413 interconnects first portion 423 with second portion 425. The tamper evidence strip 413, in this example, is located offset from hinge 427 and preferably opposite hinge 427 (e.g. 180 degrees offset from a center of the container).

In this example, the tamper evidence strip 413 is welded to, molded with and/or otherwise attached to the first and second portions 423, 425. Preferably, the strip 413 is formed (e.g. molded) with one of the portions 423, 425 and then permanently attached (e.g. using ultrasonic or heat welding) to the other portion 425, 423. In this example, a weld 439 is formed between strip 413 and second portion 425 while strip 413 is originally molded to first portion 423 (e.g. by webs 441).

To open the container 400 using the connection ring, the tamper evidence strip 413 must be broken away from one of the portions 423, 425. Typically, it will break from the connection between second portion 425 and strip 413 but it need not be at this location.

An outer rim portion of the second portion 425 includes a notch 471 in which the tamper evidence strip 413 resides when the tamper evidence strip 413 is engaged with both of the first and second portions 423, 425.

In such an arrangement, the axial outermost surface 473 of the tamper evidence strip 413, when secured to the first and second portions 423, 425 is substantially flush with or recessed below the axial outermost surface of the axially outer rim portion of second portion 425.

Figure 23:
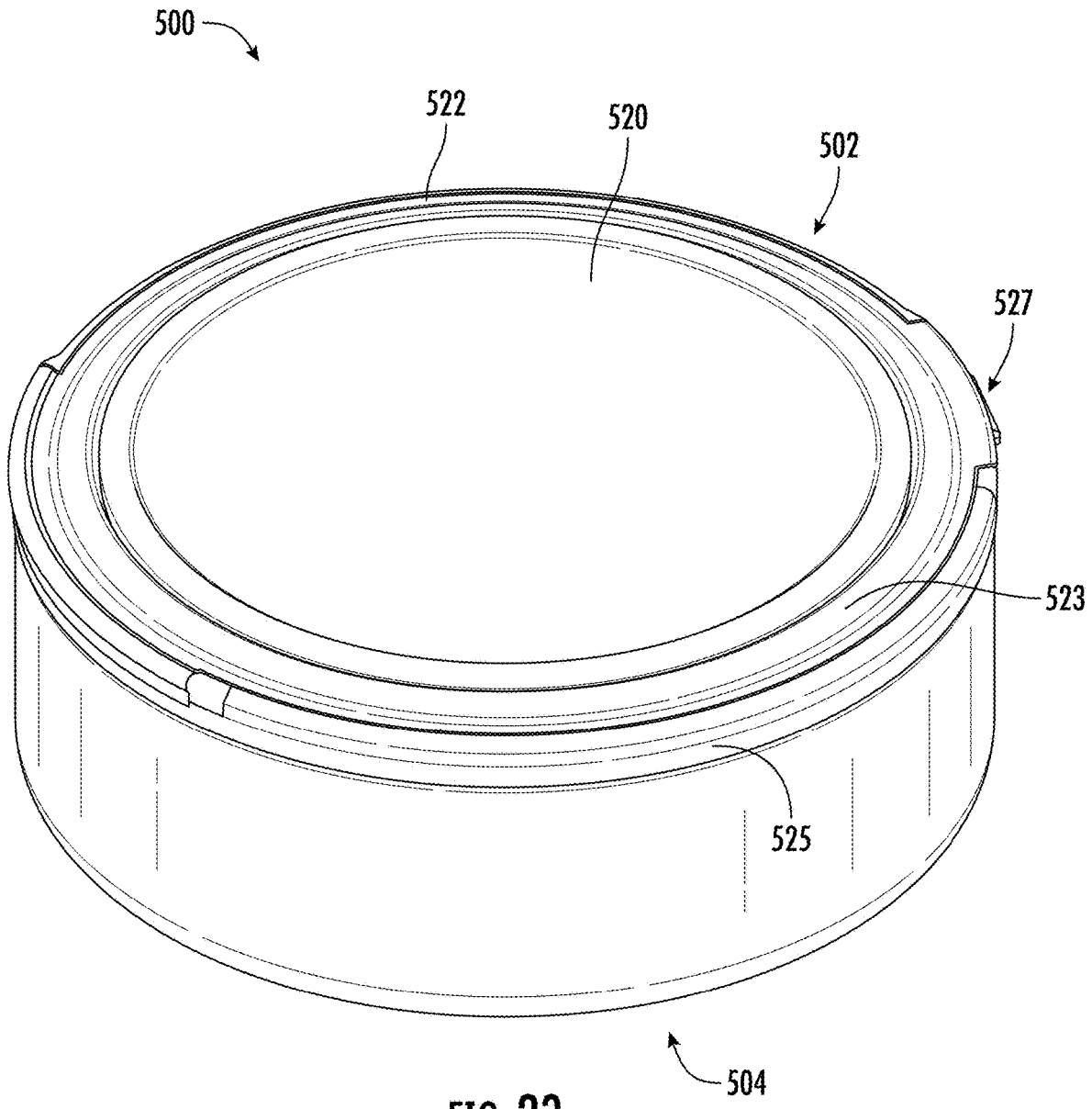
FIG. 23 is a perspective illustration of a further embodiment of a container.
Figure 24:
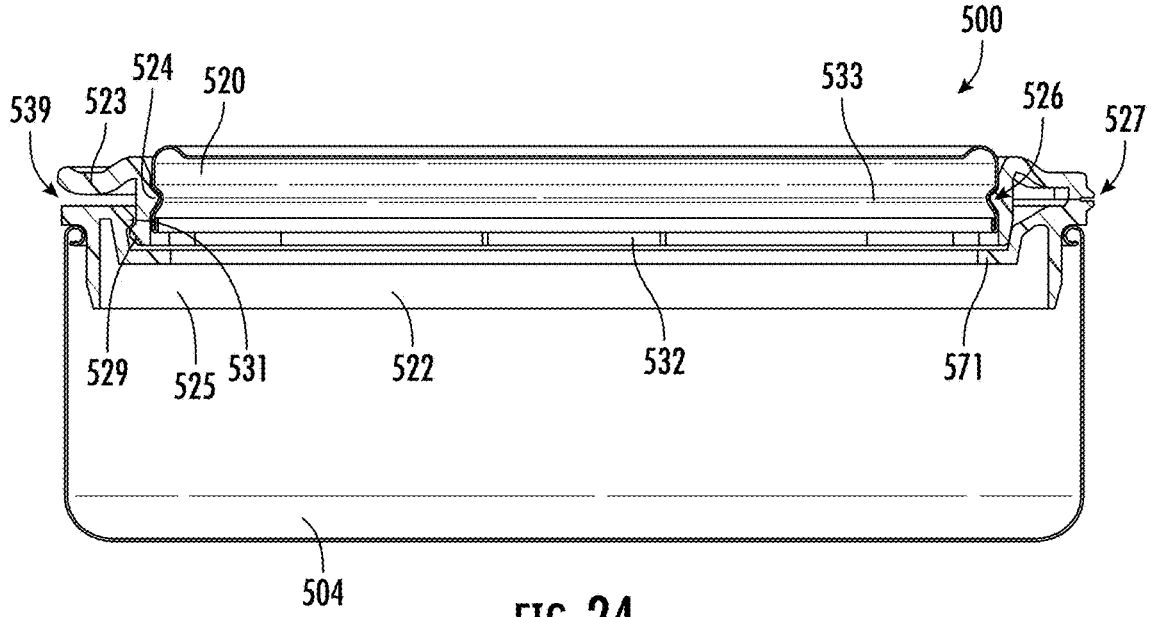
FIG. 24 is a cross-sectional illustration of the container of FIG. 23.
Figure 25:
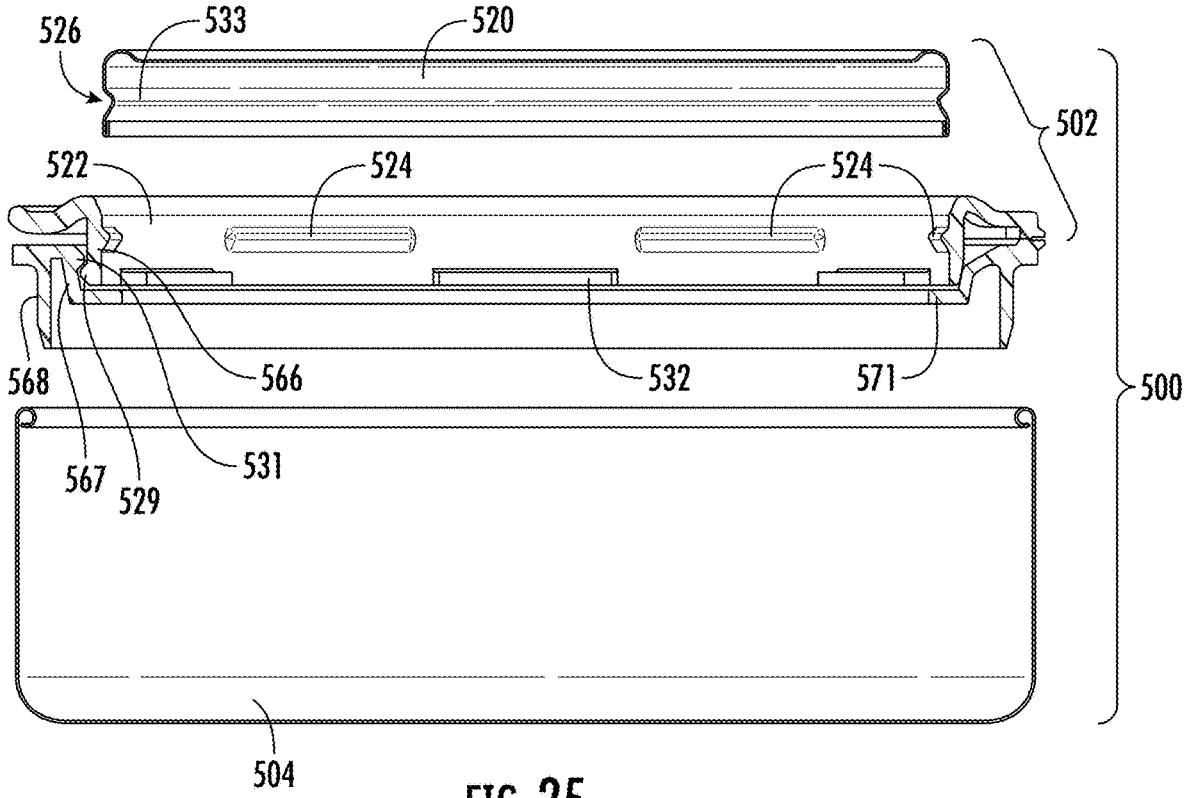
FIG. 25 is an exploded cross-sectional illustration of the container of FIG. 23.

FIGS. 23-25 illustrate a further container 500 that is similar to containers 300 and 400. The container 500 includes a lid 502 and a container bottom 504 with the lid 502 formed from a metal lid component 520, which is the same as metal lid component 120, 220, 320, 420 and a connection ring 522. The container bottom 504, in this example, is the same as the container bottom 104, 204, 304, 404 of the prior examples.

Similar to connection rings 322, 422 the connection ring 522 allows for hinged opening of the container 500. In particular, the connection ring 522 includes a first portion 523 that is hingedly attached to a second portion 525 by living hinge 527.

In this example, the metal lid component 520 is attached to the first portion 523. In this example, the first portion 523 includes one or more radially inward projecting catches 524 that radially extend into a radially inward extending groove 526 formed in the outer periphery of the sidewall of the metal lid component 520. The groove 526 is formed in the outer periphery of the sidewall by the radially inward extending bead 533 that is typically used to secure the metal lid component 520 directly to a container bottom.

Catches 524 could be a continuous annular projection and need not be separate projections as illustrated in FIG. 25.

Catches 524, in this example, extend radially inward from sidewall 566.

In this example, the metal lid component would typically be inserted into the first portion 523 from the top, rather than the bottom such as in the embodiment of container 100, for example. This is particularly true when projections 532 extend radially inward a further distance than catches 524. In other words, an inner diameter defined by the inner extent of catches 524 would be greater than an inner diameter defined by projections 532.

Each of these components 524, 532 could be continuous annular projections rather than angularly spaced apart projections.

A plurality of radially inward extending projections 532 are axially spaced from catches 524 and can prevent over insertion of the metal lid component 520 during assembly. Projections 532 extend radially inward from sidewall 566 a further distance than catches 524. While a plurality of projections 532 are illustrated, the projections 532 could take the form of a continuous annular radially inward extending flange.

A further radially inward extending flange 571 extends radially inward from sidewall 567. Flange 571 extends radially inward further than catch 531.

A finger gap 539 is formed between the first and second portions 523, 525 to facilitate opening the container 500 and particularly rotating the first portion 523 relative to the second portion 525 through hinge 527.

In this embodiment, the upper shoulder and opposed hem associated with the sidewall of the metal lid do not require engagement with inward extending catches, as in prior examples. Notably, prior examples could incorporate a same engagement between the metal lid component and the connection ring 522.

While not illustrated, sidewall 568 of the second portion 525 could engage the curl of the container bottom 504 in the same way that the prior examples are so engaged to secure the connection ring 522 to container bottom 504.

A radially outward extending catch 529 axially engages a radially inward extending catch 531 when the first and second portions 523, 525 are in the closed orientation as illustrated in FIGS. 24 and 25.

Figure 26:
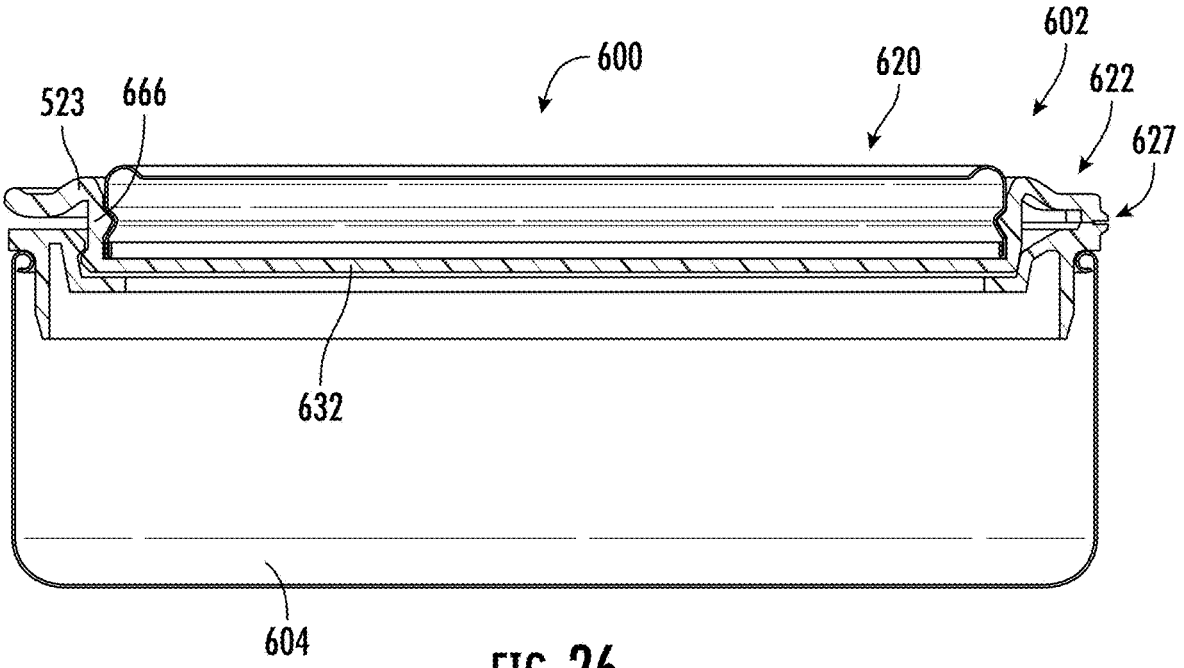
FIG. 26 is a cross-sectional illustration of a further embodiment of a container.
Figure 27:
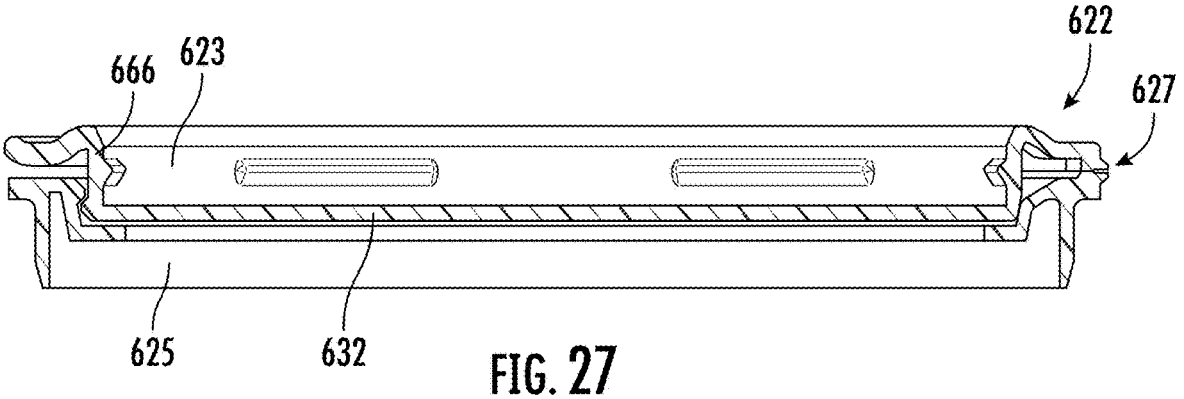
FIG. 27 is a cross-sectional illustration of the connection ring of the container of FIG. 26.

FIG. 26 illustrates a further container 600 that is similar to containers 300, 400 and 500. FIG. 27 is a cross-sectional illustration of the connection ring 622 thereof. The container 600 includes a lid 602 and a container bottom 604 with the lid 602 formed from a metal lid component 620, which is the same as metal lid component 120, 220, 320, 420, 520 and a connection ring 622. The container bottom 604, in this example, is the same as the container bottom 104, 204, 304, 404, 504 of the prior examples. Similar to connection rings 322, 422, 522, the connection ring 622 allows for hinged opening of the container 600. In particular, the connection ring 622 includes a first portion 623 that is hingedly attached to a second portion 625 by living hinge 627.

In this example, first portion 623 is fully closed. In particular, a wall 632 extends radially inward from sidewall 666 to close the first portion 623 unlike the prior embodiments. The wall 632 replaces projects 532 of the prior embodiment.

A benefit of this arrangement is that the metal lid component 620 need not be provided to fully close the container 600. Thus, it is possible to have the container bottom 604 filled and then have the connection ring 622 installed prior to having the metal lid component 620 connected to the connection ring 622 without risk of spilling.

Wall 632 can also prevent over insertion of metal lid component 620.

Otherwise, connection ring 622 is substantially identical to the prior connection ring 522.

Figure 28:
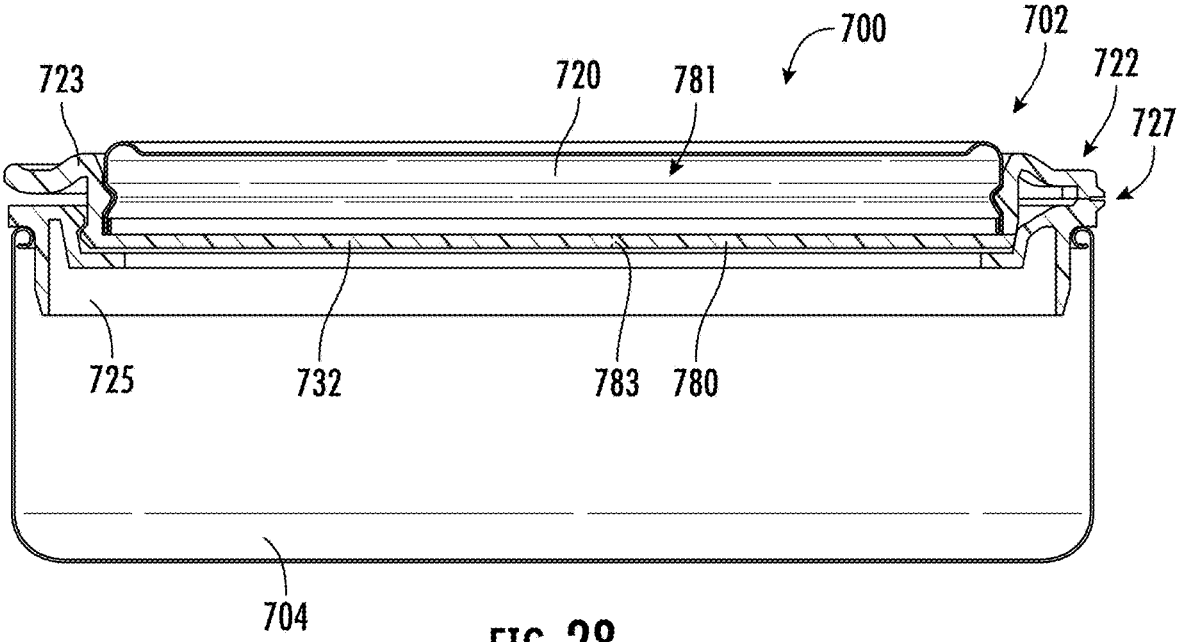
FIG. 28 is a cross-sectional illustration of a further embodiment of a container.

FIG. 28 illustrates a further container 700 that is similar to containers 300, 400, 500, 600. FIG. 28 is a cross-sectional illustration of the connection ring 722 thereof. The container 700 includes a lid 702 and a container bottom 704 with the lid 702 formed from a metal lid component 720, which is the same as metal lid component 120, 220, 320, 420, 520, 620 and connection ring 722. The container bottom 704, in this example, is the same as the container bottom 104, 204, 304, 404, 504, 604 of the prior examples.

The container 700 is substantially similar to container 600. However, wall 732 that closes the first component 723 and the connection ring 722 as well as lid 702 when the first portion 723 is in the closed position relative to second portion 725 includes a door 780.

The door 780 selectively provides access to a cavity 781 defined by the first portion 723 and the attached metal lid component 720 via opening 790. This provides a second compartment independent of the compartment defined by the lid 702 and container bottom 704.

A living hinge 783 connects the door 780 to the rest of wall 732. The living hinge 783 allows the door 780 to pivot between open and closed orientations relative to wall 732.

Figure 29:
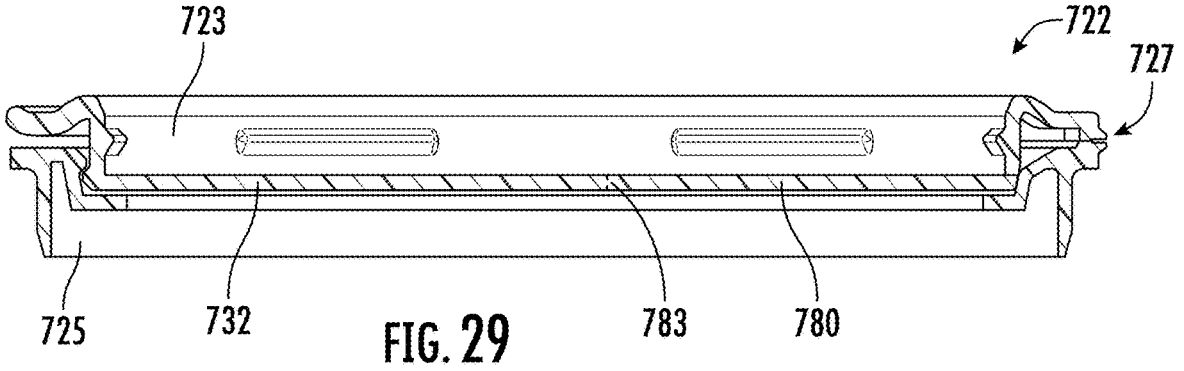
FIG. 29 is a cross-sectional illustration of the connection ring of the lid of the container of FIG. 28 with a door thereof in a closed orientation.
Figure 30:
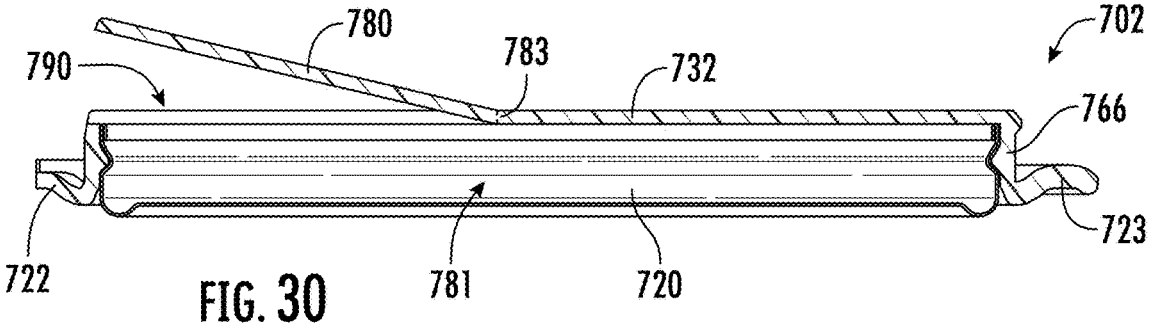
FIG. 30 is a cross-sectional illustration of a portion of the lid of the container of FIG. 28 with a door thereof to a compartment thereof in an open orientation.

As illustrated in FIG. 29, when the first and second portions 723 and 725 are in a relative closed orientation, the second portion 725 maintains door 780 of the first portion 723 in its closed orientation preventing access to cavity 781 through opening 790. This arrangement prevents the door 780 from accidentally opening when the first and second portions 723, 725 are in the closed orientation relative to one another. Also, a portion of door 780 opposite hinge 783 abuts a distal end portion of sidewall 766 to prevent door 780 from being overly pushed into cavity 781.

The door 780 can include a tab 787 that cooperates with a notch 786 formed in the sidewall 766 of the first portion 723. The tab 787 is configured to secure the door 780 in the closed orientation. Tab 787 and notch 786 may have a snap engagement, press fit/friction engagement, or other engagement to maintain the door 780 in the closed orientation.

Figure 31:
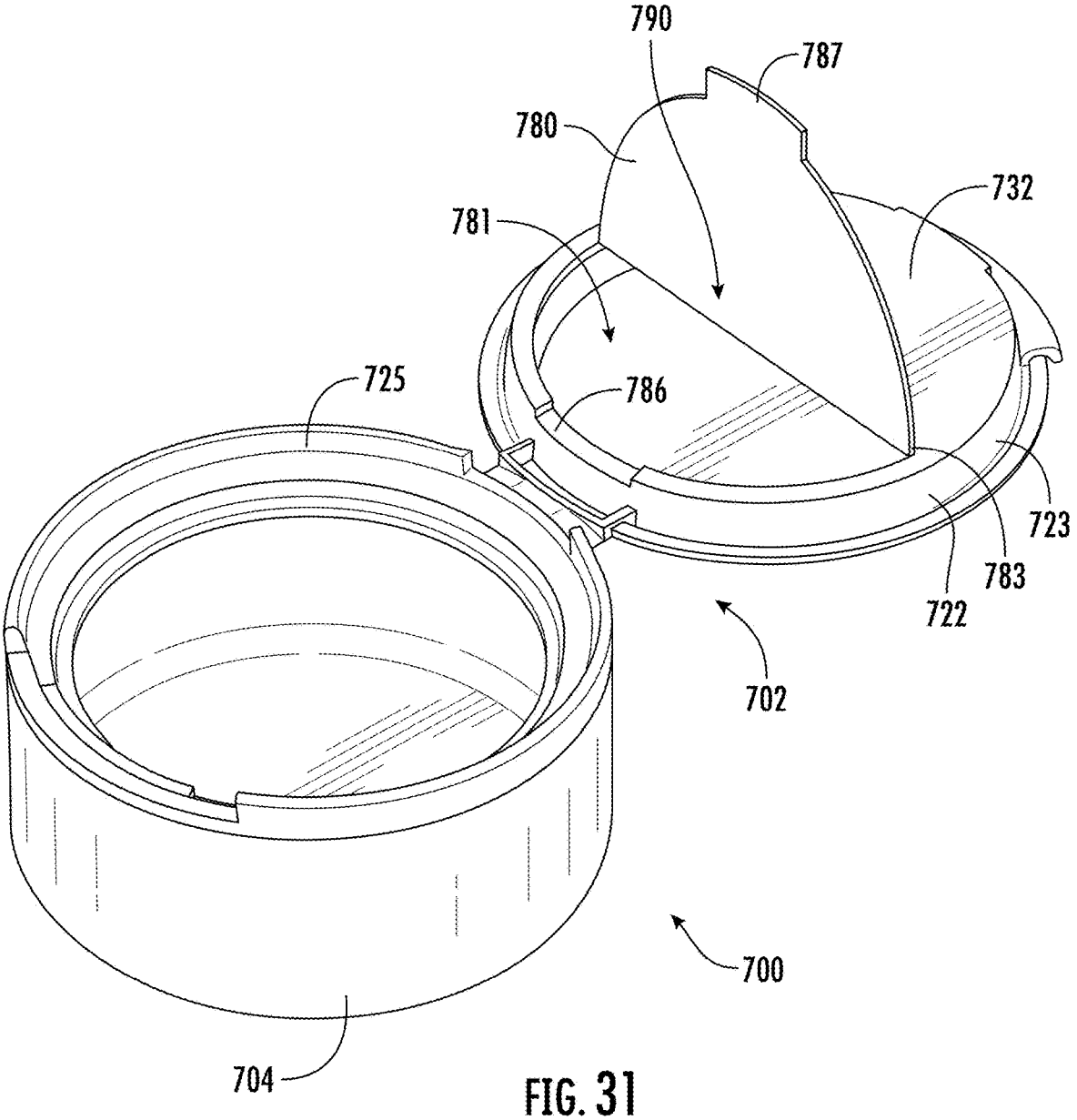
FIG. 31 is a perspective illustration of the container of FIG. 28 with the lid in an open orientation and a door of the connection ring thereof also in an open orientation.

Typically, the container 700 would be configured that access to cavity 781 was only possible when the container 700 and particularly the first portion 723 of connection ring 722 is in an open orientation relative to second portion 725, such as illustrated in FIG. 31.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container lid comprising:

a metal lid component that is cup shaped including a top wall and an annular lid sidewall connected to and extending from the top wall, the lid sidewall terminating in a distal end;

a plastic connection ring circumscribing the lid sidewall, the connection ring having:

a first radially inward extending portion and a second radially inward extending portion axially spaced from the first radially inward extending portion forming a first axial gap therebetween, at least a portion of the lid sidewall being positioned within the first axial gap axially between the first and second radially inward extending portions securing the metal lid component to the plastic connection ring;

a first radially outward extending portion and a second radially outward extending portion axially spaced from the first radially outward extending portion forming a second axial gap therebetween;

wherein:

the second radially inward extending portion is a wall, the wall and the metal lid component define a cavity therebetween, the wall having a hingedly attached door, the door closing an opening through the wall into the cavity when in a closed orientation and providing access to the cavity through the wall into the cavity when in an open orientation;

the connection ring has a first portion hingedly attached to a second portion, the metal lid component being attached to the first portion; and the second portion of the plastic connection ring maintains the door of the first portion of the plastic connection ring in the closed orientation when the first portion is in a closed orientation relative to the second portion.

2. The container lid of claim 1, wherein:

the connection ring has a first ring sidewall and a second ring sidewall spaced radially outward from the first ring sidewall forming an annular groove therebetween;

the first and second radially inward extending portions extending from the first ring sidewall;

the first and second radially outward extending portions extending from the second ring sidewall.

3. The container of claim 1, wherein:

a rounded shoulder connects the lid sidewall to the top wall;

the first radially inward extending portion is a radially inward extending catch that defines an abutment surface having a rounded profile shaped and sized to mate with the rounded shoulder.

4. The container of claim 1, wherein the connection ring has a top end and a bottom end, the metal lid component projects axially above the top end of the connection ring.

5. The container lid of claim 1, wherein the distal end of the lid sidewall is folded or curled radially inward forming a curl or a hem.

6. The container lid of claim 1, wherein the first and second portions formed from a single continuous piece of material.

7. The container lid of claim 6, wherein the first radially inward extending portion and the second radially inward extending portion are provided by the first portion; and the first radially outward extending portion and the second radially outward extending portion are provided by the second portion.

8. The container lid of claim 6, further including a tamper evidence strip permanently attached to the first and second portions and is configured to be broken to transition the first portion relative to the second portion from a closed orientation to an open orientation.

9. A container comprising:

a container bottom having a bottom wall and an annular bottom sidewall extending from the bottom wall, the bottom sidewall having a radially inward extending projection, the projection defining an opening into a storage cavity of the container bottom; and the container lid according to claim 1 selectively engageable with the projection to removably secure the lid to the container bottom, the projection of the container bottom positioned within the second axial gap axially between the first and second radially outward extending portions releasably securing the container bottom to the plastic connection ring.

10. The container of claim 9, wherein when the connection ring is engaged with the projection of the container bottom, at least a portion of the lid sidewall extends axially above the radially inward extending projection of the container bottom.

11. The container of claim 9, wherein when the connection ring is engaged with the projection of the container bottom, the first radially inward and outward extending portions are positioned external of the container bottom and the second radially inward and outward extending portions are, at least in part, positioned within the container bottom.

12. The container of claim 9, wherein:

the connection ring defines a central axis;

the metal lid component has a maximum diameter measured perpendicular to the central axis;

the projection defines a minimum diameter measured perpendicular to the central axis, the minimum diameter of the projection being greater than the maximum diameter of the metal lid component.

13. The container of claim 9, wherein the projection of the container bottom is a radially inwardly directed curled portion of the bottom sidewall.

14. The container of claim 9, wherein the lid sidewall and top wall are connected by a shoulder formed therebetween, when the container lid is attached to the container bottom in a closed orientation, the shoulder of the metal lid component extends axially away from the container bottom beyond the connection ring.

15. The container of claim 9, wherein the connection ring has a maximum radially outer periphery that has a same diameter as a maximum radially outer periphery of the bottom sidewall.

16. A container lid comprising:

a metal lid component is cup shaped including a top wall and an annular lid sidewall connected to and extending from the top wall, the lid sidewall terminating in a distal end;

a plastic connection ring circumscribing the lid sidewall, the connection ring having a first portion hingedly attached to a second portion, the metal lid component being attached to the first portion, the first portion of the connection ring and metal lid component defining a cavity, the first portion having a hingedly attached door closing an opening into the cavity defined by the first portion when in a closed orientation and providing access to the cavity through the opening when in an open orientation; and wherein the second portion of the plastic connection ring maintains the door of the first portion of the plastic connection ring in the closed orientation when the first portion is in a closed orientation relative to the second portion.

17. The container lid of claim 16, wherein the door is connected to the rest of the first portion by a living hinge.

* * * * *